US011384546B2

(12) United States Patent
Becker

(10) Patent No.: US 11,384,546 B2
(45) Date of Patent: Jul. 12, 2022

(54) FORMWORK WITH HEIGHT ADJUSTABLE SUPPORT FOR FORMING CONCRETE SURFACES THAT TRANSITION BETWEEN UPWARD SLOPING AND DOWNWARD SLOPING

(71) Applicant: Brand Shared Services LLC, Kennesaw, GA (US)

(72) Inventor: Allan James Becker, Richmond Hill (CA)

(73) Assignee: BRAND SHARED SERVICES LLC, Kennesaw, GA (US)

( * ) Notice: Subject to any disclaimer, the term of this patent is extended or adjusted under 35 U.S.C. 154(b) by 0 days.

(21) Appl. No.: 16/967,166

(22) PCT Filed: Feb. 5, 2019

(86) PCT No.: PCT/US2019/016610
§ 371 (c)(1),
(2) Date: Aug. 4, 2020

(87) PCT Pub. No.: WO2019/156958
PCT Pub. Date: Aug. 15, 2019

(65) Prior Publication Data

US 2021/0079670 A1 Mar. 18, 2021

(30) Foreign Application Priority Data

Feb. 6, 2018 (CA) ..... 2994076

(51) Int. Cl.
*E04G 11/48* (2006.01)
*E04G 11/50* (2006.01)
*E04G 17/00* (2006.01)

(52) U.S. Cl.
CPC ..... *E04G 11/486* (2013.01); *E04G 11/50* (2013.01); *E04G 17/005* (2013.01)

(58) Field of Classification Search
CPC ..... E04G 11/50; E04G 11/486; E04G 11/483; E04G 17/005; E04G 11/38
See application file for complete search history.

(56) References Cited

U.S. PATENT DOCUMENTS 1,907,877 A * 5/1933 Roos ..... E04G 11/486 249/193
10,053,875 B1 * 8/2018 Baron ..... E04G 11/486
(Continued)

FOREIGN PATENT DOCUMENTS

CA 2475339 A1 * 12/2004 ..... E04G 11/38
CA 2988166 A1 * 3/2019 ..... E04G 11/483
(Continued)

OTHER PUBLICATIONS

International Search Report and Written Opinion dated Jun. 26, 2019 which pertains to PCT/US2019/016610 with a filing date of Feb. 5, 2019, 7 pages.
(Continued)

*Primary Examiner* — Michael Safavi
(74) *Attorney, Agent, or Firm* — Dinsmore & Shohl LLP

(57) ABSTRACT

A formwork system for supporting forming panels to form a horizontal concrete surface. The system includes a height-adjustable support having a central upstanding member providing a vertical abutment surface and a support arm having an inclined portion extending up and away from said central upstanding member. The system also includes a beam having a transverse bar proximate an end. The transverse bar is supported by the inclined portion of the support arm so that said transverse bar moves laterally relative to the inclined portion as the support arm is moved vertically. The beam also has a foot extending from the end of the beam and
(Continued)

abutting the abutment surface. The abutment surface opposes lateral movement of the beam relative to the upstanding member.

19 Claims, 31 Drawing Sheets

(56) References Cited

U.S. PATENT DOCUMENTS

| | | | | |
|---|---|---|---|---|
| 2003/0209648 | A1 | 11/2003 | Schworer | |
| 2006/0042179 | A1 * | 3/2006 | Vanagan | E04G 11/56 52/633 |
| 2019/0277044 | A1 * | 9/2019 | Faresin | E04G 11/50 |

FOREIGN PATENT DOCUMENTS

| | | | | |
|---|---|---|---|---|
| CN | 101413346 | A | 4/2009 | |
| CN | 206646809 | U | 11/2017 | |
| CN | 206785404 | U | 12/2017 | |
| DE | 3316557 | C1 | 10/1984 | |
| DE | 4204773 | A1 * | 8/1993 | E04G 11/486 |
| DE | 4204788 | A1 | 8/1993 | |
| DE | 10 2004 004 883 | A1 | 3/2005 | |
| DE | 102006055306 | A1 * | 5/2008 | E04G 11/483 |
| EP | 1375781 | A1 | 1/2004 | |
| EP | 3112556 | A1 | 1/2017 | |
| FR | 2821104 | A1 * | 8/2002 | E04G 11/486 |
| JP | 2001262823 | A1 | 9/2001 | |
| KR | 100653229 | B1 | 12/2006 | |
| KR | 20090028398 | A | 3/2009 | |
| KR | 20090076813 | A | 7/2009 | |
| KR | 20120037696 | A | 4/2012 | |
| WO | 200610069 | A1 | 9/2006 | |
| WO | 2015090995 | A1 | 6/2015 | |
| WO | WO-2019202623 | A1 * | 10/2019 | E04G 17/005 |

OTHER PUBLICATIONS

First Chinese Office Action issued by the Chinese Patent Office dated Sep. 10, 2021 in connection with Chinese Patent Application No. 201980017393.8, 14 pages.

Extended European Search Report issued by the European Patent Office dated Oct. 19, 2021 in connection with European Patent Application No. 19751109.0, 9 pages.

* cited by examiner

FORMWORK WITH HEIGHT ADJUSTABLE SUPPORT FOR FORMING CONCRETE SURFACES THAT TRANSITION BETWEEN UPWARD SLOPING AND DOWNWARD SLOPING

CROSS-REFERENCE TO RELATED APPLICATIONS

This application claims priority from Canadian Patent Application No. 2,994,076 filed Feb. 6, 2018, the contents of which are incorporated herein by reference.

FIELD

A formwork system for supporting forming panels to form a horizontal concrete surface.

BACKGROUND

Formwork systems provide a temporary mold into/onto which liquid concrete can be poured. After the liquid concrete sets, the formwork may be removed, leaving behind a concrete structure. Formwork systems are used in building numerous types of structures, including buildings, bridges, parking garages, and so forth.

Formwork systems may be used to form vertical concrete structures as well as horizontal concrete surfaces. Formwork systems may also be used to form inclined surfaces, for example, by inclining the beams. Inclined surfaces are useful in many applications, for example, to form ramps in parking garages.

However, traditional formwork systems are ill-suited for forming inclined surfaces. One problem with traditional formwork system is that gaps may form between forming panels. For example, a forming panel suspended by a first beam may not touch a forming panel suspended on an adjacent beam. Such gaps between panels are typically filled with thin strips that span the width of the forming panels (also known as 'compensation-strips').

Accordingly, improvements in formwork systems are desirable.

SUMMARY

In accordance with an aspect of the present disclosure, there is provided a formwork system for supporting one or more forming panels to form a horizontal concrete surface. The system includes: a height-adjustable support comprising a central upstanding member providing a vertical abutment surface and a support arm having an inclined portion extending up and away from the central upstanding member; a beam comprising a transverse bar proximate an end, the transverse bar supported by the inclined portion of the support arm so that the transverse bar moves laterally relative to the inclined portion as the support arm is moved vertically; and a foot extending from the end of said beam and abutting the vertical abutment surface, wherein the vertical abutment surface opposes lateral movement of the beam relative to said upstanding member.

In one embodiment, an increase in the height of said support causes the transverse bar to move towards the central upstanding member along the inclined portion.

In one embodiment, a decrease in the height of said support causes the transverse bar to move away from the central upstanding member along the inclined portion.

In one embodiment, an incline angle of the beam is adjustable by adjusting the height of the support.

Other aspects, features, and embodiments of the present disclosure will become apparent to those of ordinary skill in the art upon review of the following description of specific embodiments in conjunction with the accompanying figures.

BRIEF DESCRIPTION OF DRAWINGS

In the figures, which illustrate, by way of example only, embodiments of the present disclosure.

DETAILED DESCRIPTION

When formwork systems are used form inclined surfaces, different sized gaps may result between forming panels. Forming panels are typically laterally secured to beams of the formwork system to prevent the beams from sliding along the beams. The lateral position of forming panels along the beams cannot be adjusted when beams are inclined. There may be large gaps between some forming panels and small gaps between other forming panels. Such systems are therefore ill suited for forming inclined surfaces.

Alternatively, forming panels may be laterally unsecured to the beams to accommodate the use of a formwork system to form inclined surfaces. A worker can thus adjust the lateral position of the forming panels along the beams to accommodate the inclined beams to maintain panel gaps at a substantially constant size. However, laterally unsecured forming panels create a safety hazard as workers may walk on top of the forming panels from time-to-time. If a forming panel slides as a worker steps on the panel, the worker may fall and sustain an injury.

Disclosed is a formwork system adapted for forming concrete surfaces that transition from level to sloping (or vice-versa). In particular, the formwork system includes a height-adjustable support for supporting a beam in substantially horizontal position. The support includes a central upstanding member and a support arm. The support arm has an inclined portion extending up and away from the central upstanding member. The beam has a transverse bar, which is supported by the inclined portion of the support arm. As the support moves vertically, the transverse bar moves laterally relative to the inclined portion. A foot at the beam abuts the central upstanding member and opposes lateral movement of the beam relative to the upstanding member when the support is stationary.

Thus, when the support arm moves up or down vertically, the beam moves both horizontally and vertically along the inclined portion. In turn, the lateral shift of the beam in response to vertical shift of the support is reduced. Thus, the variance in the gap between laterally secured forming panels is also reduced. As a result, a single type of compensation-strips having an adjustable width can be used with the system.

Figure 1A:
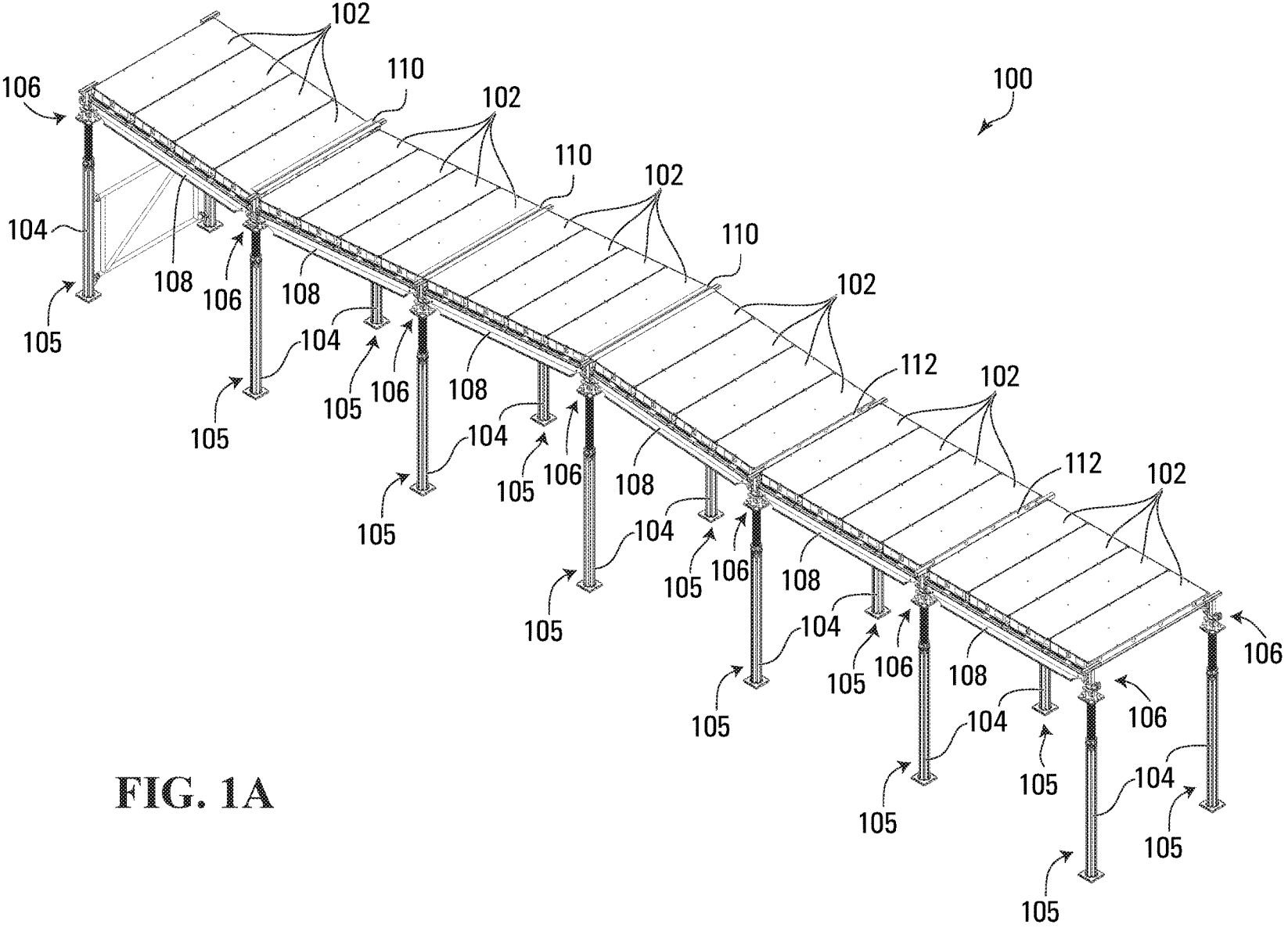
FIG. 1A is a top-perspective view of a formwork system 100 in accordance with an example embodiment.
Figure 1B:
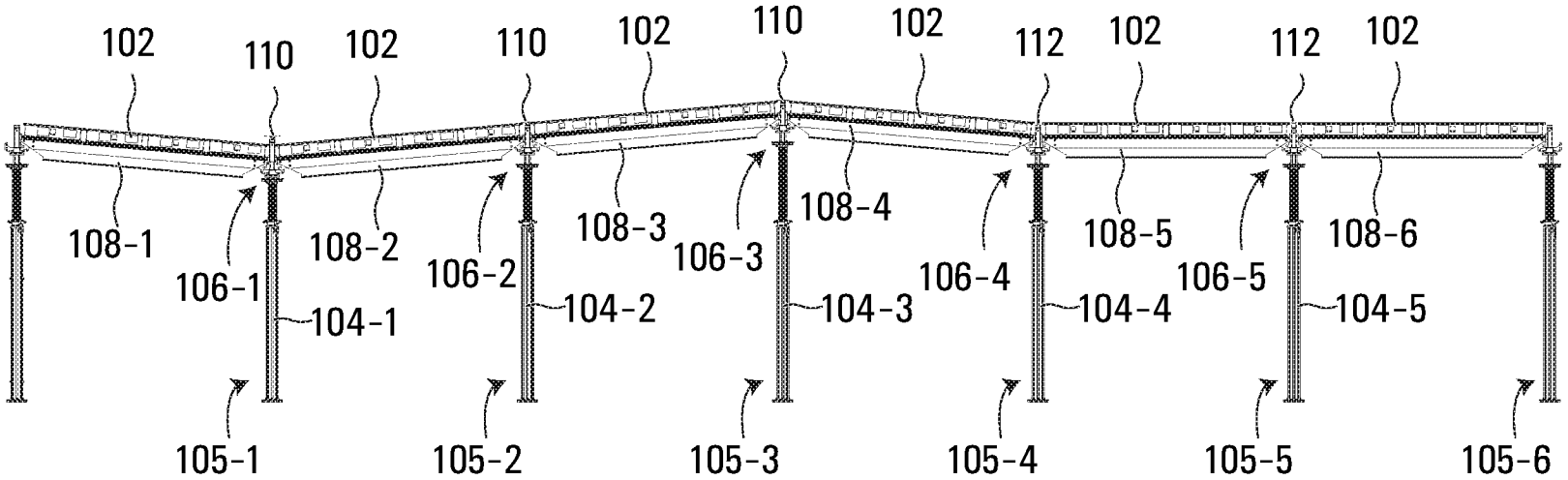
FIG. 1B is a side views of formwork system 100 in accordance with an example embodiment.

Reference is made to FIGS. 1A-1B, illustrating perspective and side views of a formwork system 100 for supporting one or more forming panels 102.

Forming panels 102 provide a flat surface to pour liquid concrete thereon. In one embodiment, a plywood panel is used to provide the flat surface. In one embodiment, forming panels 102 may be 2 feet wide and 6 feet long. However, other sizes are possible: for example, forming panels 102 may range from 1 foot to 6 feet in length or width. In addition, different sized forming panels 102 may be used with formwork system 100.

In one embodiment, each plywood panel of a forming panel 102 is supported by beams (not shown) extending along the edges of the panel. The plywood panel may also be supported by a series of beams spanning the length or width of the panel. The beams of a forming panel 102 may be made of a light material, such as wood or aluminum.

Formwork system 100 also includes a plurality of supports 105 and beams 108. Each support 105 has base portion 104 and a support head 106 at an upper portion of support 105. Beams 108 are supported at each end by support head 106. In one embodiment, support head 106 is removably mounted on a vertical prop.

One or more supports 105 of system 100 may also support a compensation-strip 110. Compensation-strips 110 may be used to fill gaps 112 between panels 102 that form around support heads 106.

In use, a first pair of supports 105 (for example, including a pair of support heads 106 and a pair of vertical props) may be used to suspend a first beam 108. A second pair of supports 105 may be used to suspend a second beam 108 in a substantially parallel position to the first beam 108. One or more forming panels 102 may be supported on each of the first and second beams to form a suspended horizontal surface suitable for pouring concrete thereon. The horizontal surface formed by system 100 may have sections that are inclined and sections that are level.

Additional beams 108, supports 105, and forming panels 102 can be arranged side-by-side to form a larger suspended horizontal surface suitable for pouring concrete thereon.

As illustrated in FIG. 1B, formwork system 100 allows for forming leveled and inclined horizontal concrete surfaces. In addition, formwork system 100 may be used to form a single horizontal concrete surface that transitions between upward sloping and downward sloping. For example, as illustrated in FIG. 1B beam 108-1 and the panels associated therewith are sloping up relative to support head 106-1. Similarly, beam 108-2 and the panels associated therewith are sloping down from support head 106-2. Similarly, beam 108-3 and the panels associated therewith are sloping down from support head 106-3. Similarly, beam 108-4 and the panels associated therewith are sloping up relative to support head 106-4. Similarly, beam 108-5 and the panels associated therewith are level with support head 106-5. Beam 108-6 and the panels associated therewith also level.

The incline angle of a particular beam may be adjusted by adjusting the height of one of the supports 105 supporting that particular beam (for example, by adjusting the height of one of or both of support head 106 and vertical prop 104 supporting support head 106). As illustrated in FIG. 1B, the heights of supports 105-1 to 105-6 are varied (or base portion 104-1 to 104-5, for example, using height adjustable vertical props) to achieve the desired angle of each of beams 108-1 to 108-6.

In one embodiment, the maximum incline angle of a beam 108 and the forming panels 102 associated therewith is plus or minus 5 degrees relative to the horizontal.

Figure 1C:
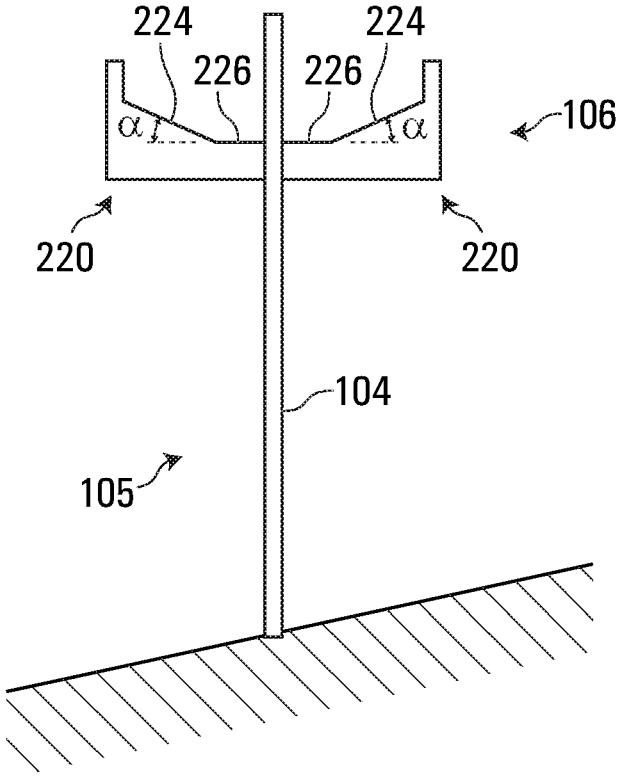
FIG. 1C is a side view of a support for use with the formwork system 100 in accordance with an example embodiment.

Reference is made to FIG. 1C illustrating an example support 105 for use formwork system 100 in accordance one embodiment. Support 105 has a support head 106 having support arms 220. Support head 106 and support arms 220 thereof are supported in an elevated position by base portion 104 of support 105. Beams 108 are supported at each end by support arms 220 of support head 106.

Support arms 220 may be lowered or raised to vary the slope of beams supported by the support head 106. In one embodiment, support head 106 is mounted on a height-adjustable vertical prop, and the height of support arms 220 is adjustable by adjusting the height of the vertical prop. In one embodiment, support head 106 has support arms 220 that are height-adjustable independently from base portion 104.

As shown, support 105 has two support arms 220 positioned on opposite sides of support 105, but other embodiments are possible. For example, each support 105 may have four support arms 220.

Support arm 220 of support 105 has an inclined portion 224 extending up and away from the center of support head 106. In one embodiment, support arm 220 also has a flat portion 226 extending laterally from the center of support head 106 and inclined portion 224 extends up and away from flat portion 226. Inclined portion 224 has an angle of a degrees relative to the horizontal, which may in some embodiments range from 30 to 40 degrees.

Support 105 also has a central upstanding member 230 at the center of support head 106. Central upstanding member 230 extends vertically upwards relative to support arms 220. Inclined portion 224 extends up and away from central upstanding member 230.

Beam 108 may abut central upstanding member 230, and in turn, central upstanding member 230 may oppose lateral movement of beam 108; thereby laterally stabilizing beam 108.

Figure 1D:
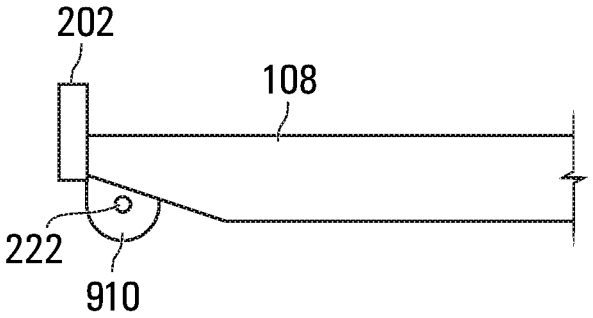
FIG. 1D is a side view of a beam for use with the formwork system 100 in accordance with an example embodiment.

Reference is made to FIG. 1D illustrating a partial side view of an example beam 108 for use with formwork system 100 in accordance one embodiment.

Figure 9A:
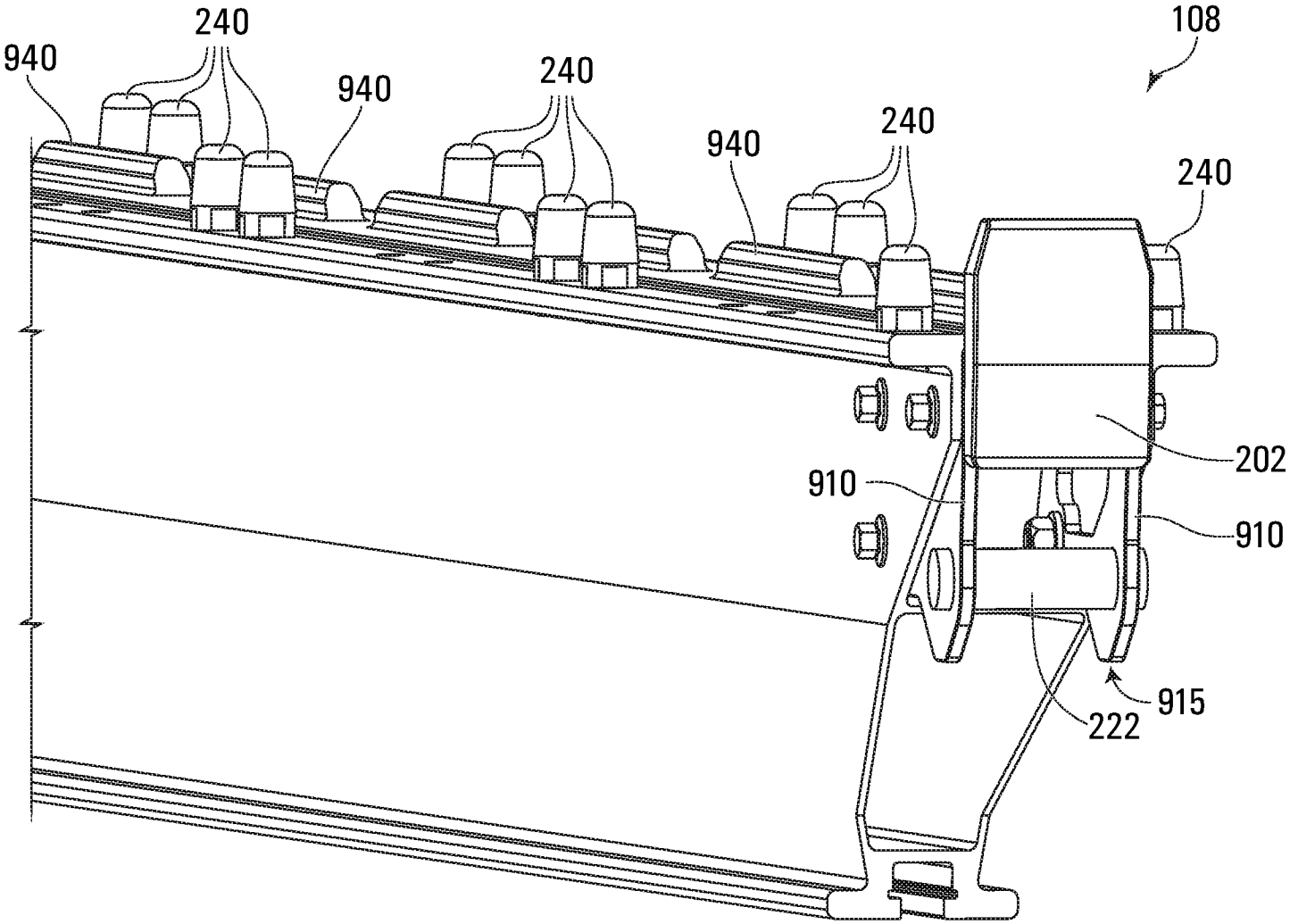
FIG. 9A is a top-perspective view of a beam for use with the formwork system 100 in accordance with an example embodiment.
Figure 9B:
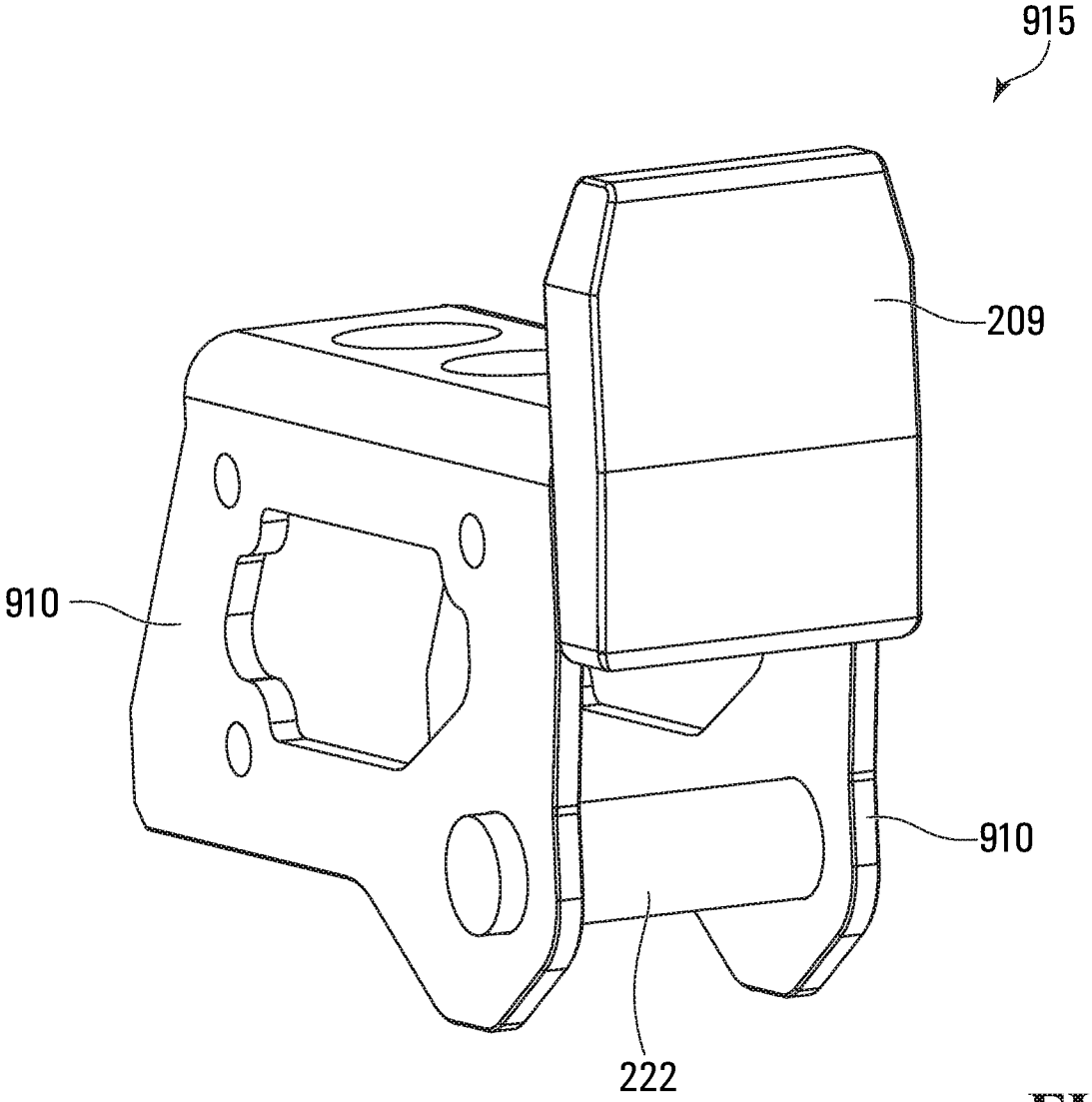
FIG. 9B is a top-perspective view of a saddle member for use with the beam of FIG. 9A.
Figure 9C:
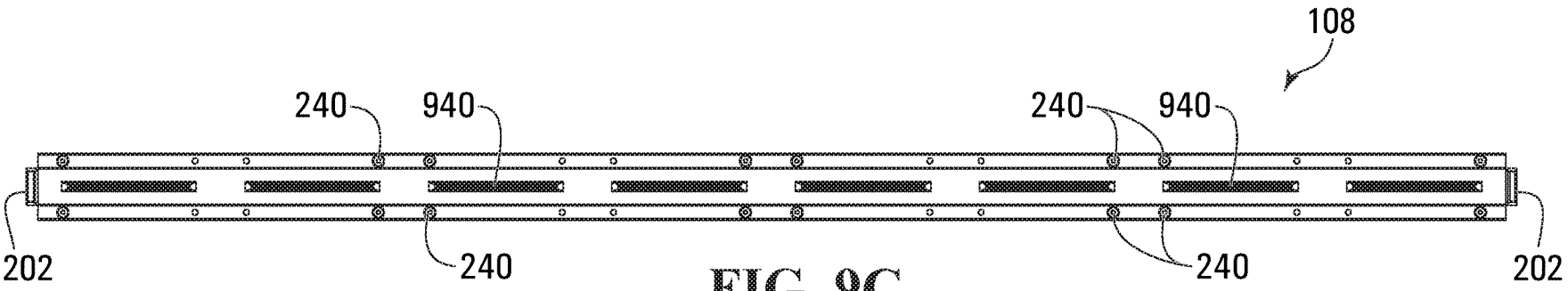
FIGS. 9C-9E are top, side, and bottom views of the beam of FIG. 9A.

In one embodiment, beam 108 has two side plates 910 attached proximate an end of the beam and extending away from the beam. In one embodiment, side plates 910 secure a transverse bar 222 in a position proximate the end of the beam (see FIGS. 9A-9B).

In use, transverse bar 222 may be supported by inclined portion 224 of support arm 220 to suspend beam 108. As will be explained further, the position of transverse bar 222 along inclined portion 224 may vary in dependence on the incline angle of beam 108 when suspended.

In one embodiment, beam 108 also has a foot 202 extending from the end of the beam. In one embodiment, foot 202 is a small metallic block (for example, made of steel) attached to the end of beam 108. In one embodiment, foot 202 has thickness of 1 to 3 cm. In one embodiment, foot 202 is longer than the height of an end portion of beam 108, such that foot 202 may extend relative to the upper and lower surfaces of the end portion of beam 108. In one embodiment, foot 202 may be positioned substantially perpendicular to beam 108.

In one embodiment, foot 202 is positioned at the end-most portion of beam 108, such that a portion of foot 202 may abut central upstanding member 230 (FIG. 1C), and in turn, may oppose lateral movement of beam 108 to laterally stabilizing beam 108.

Accordingly, central upstanding member 230 provides a vertical abutment surface for foot 202 to oppose lateral movement of beam 108 relative to central upstanding member 230. By abutting vertical abutment surface, foot 202 may prevent transverse bar 222 from moving laterally along inclined portion 224.

In one embodiment, foot 202 is any extension to beam 108 that provides a suitable abutment surface to laterally stabilize beam 108.

Figure 2A:
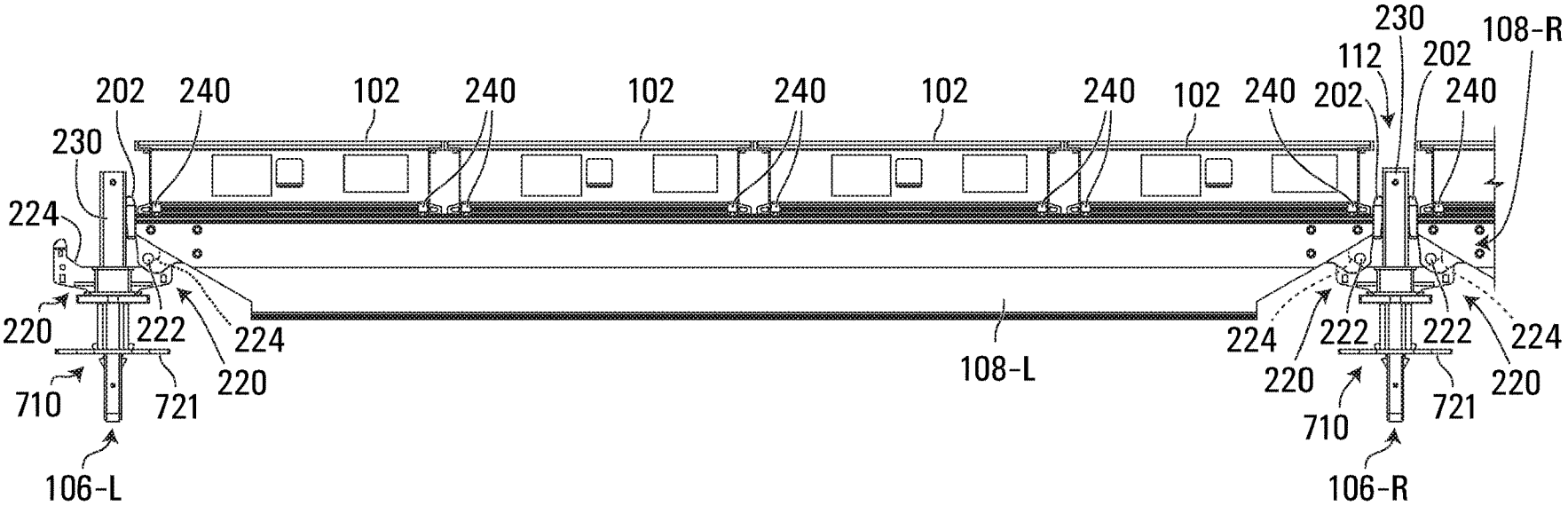
FIGS. 2A-2C and 2E-2F are close-up side views of the formwork system 100.
Figure 2B:
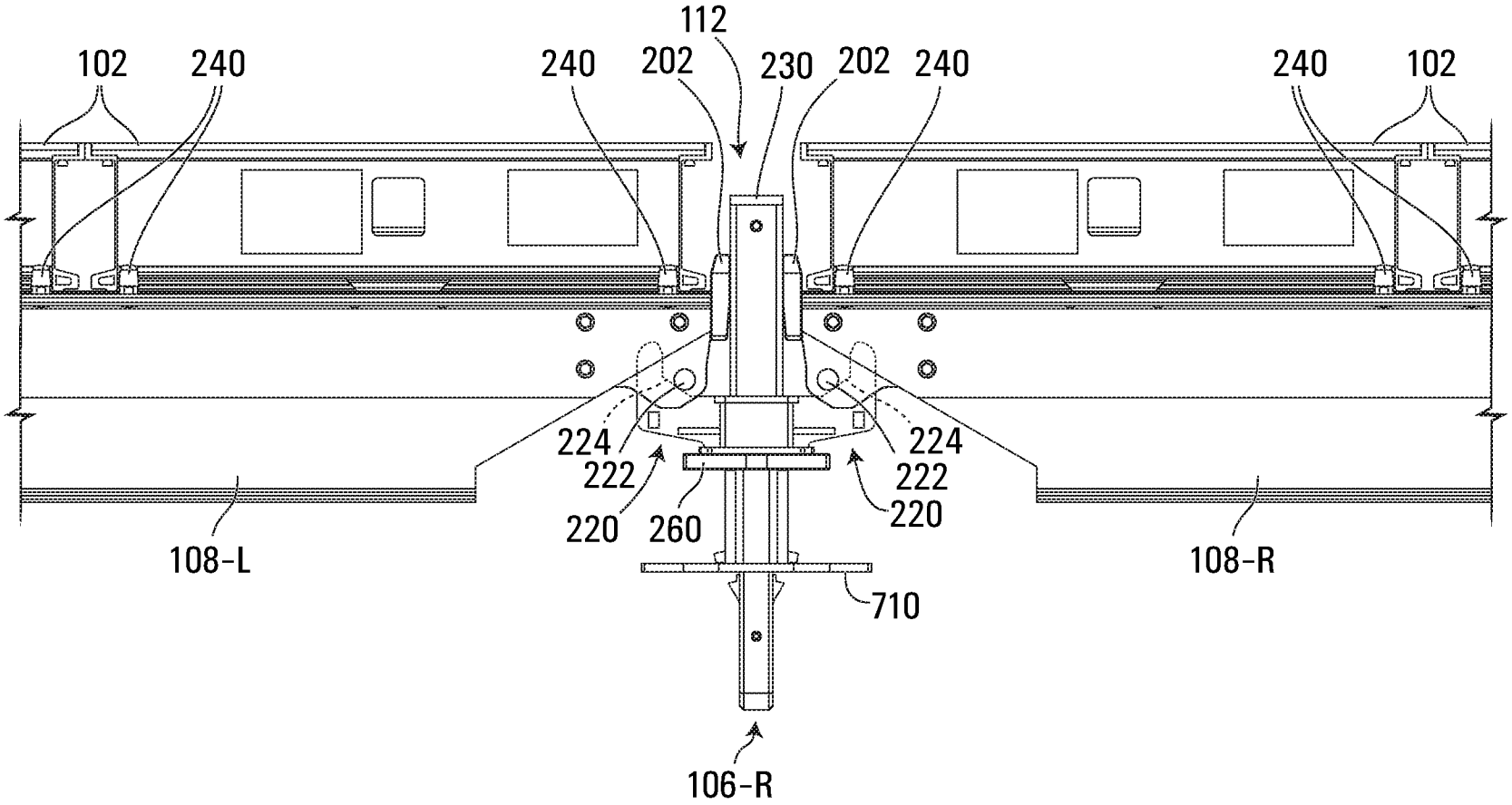

Reference is made to FIGS. 2A and 2B, illustrating beams 108-L, 108-R (generally referred to as "beams 108") and support heads 106-L, 106-R (generally referred to as "support heads 106"). Support heads 106 are each supported in an elevated position, for example by a vertical prop (not shown).

Beam 108-L is supported by support arms 220 of support head 106-L at one end and by support arms 220 of support head 106-R at a second end in a level position. Beam 108-R is supported by support arms 220 of support head 106-R at one end and by support arms 220 of a second support head (not shown) at a second end (not shown) in a level position.

When beam 108 is in a level/horizontal position, transverse bar 222 is supported approximately at the middle of inclined portion 224 of support arm 220 (as shown in phantom in FIG. 2B). Further, foot 202 is substantially perpendicular to central upstanding member 230.

Each beam 108 has protrusions 240 extending upwardly from an upper surface of the beam. Each protrusion 240 is configured to engage the lower surface of a forming panel 102 to prevent lateral movement of the forming panel 102 along beam 108.

Figure 2C:
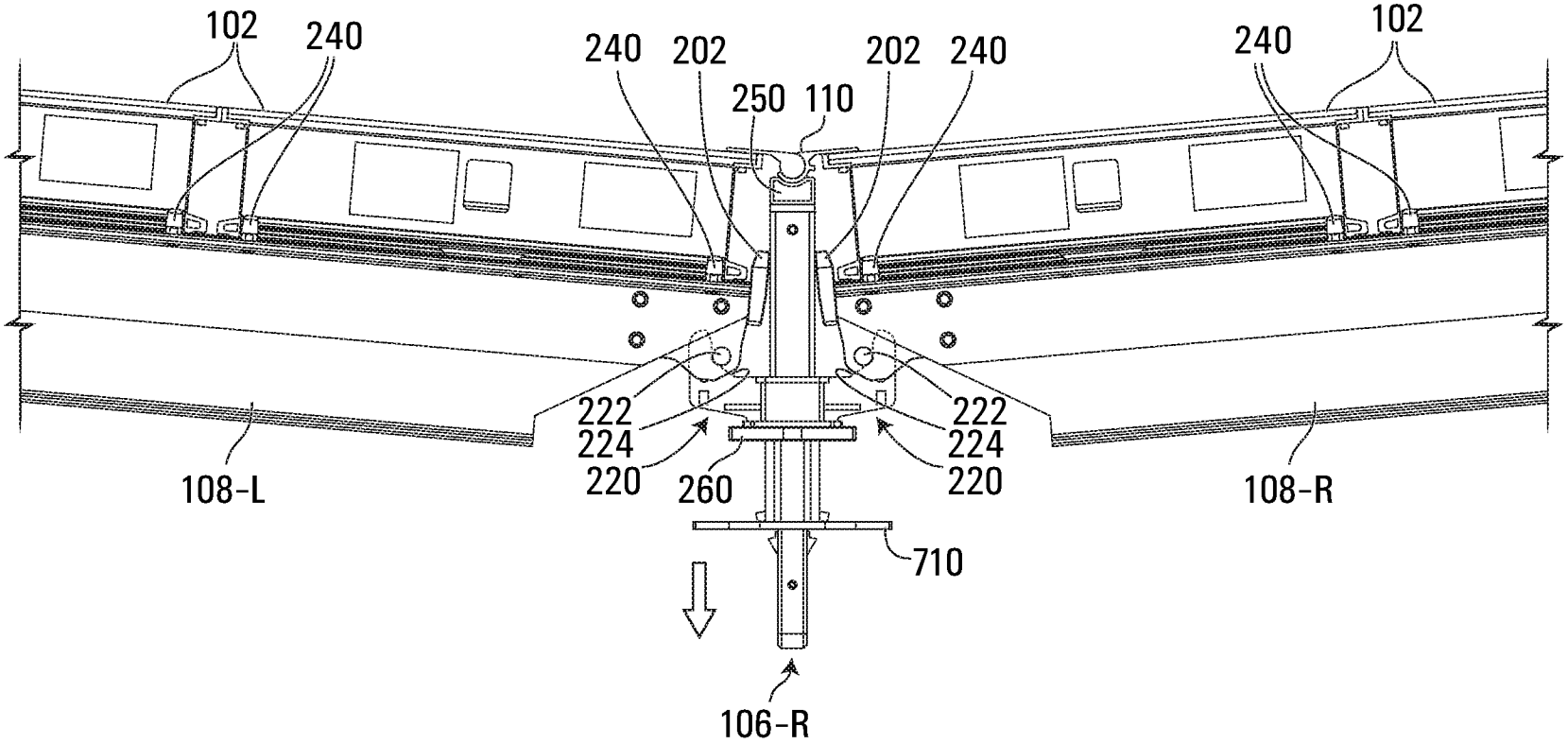
Figure 2D:
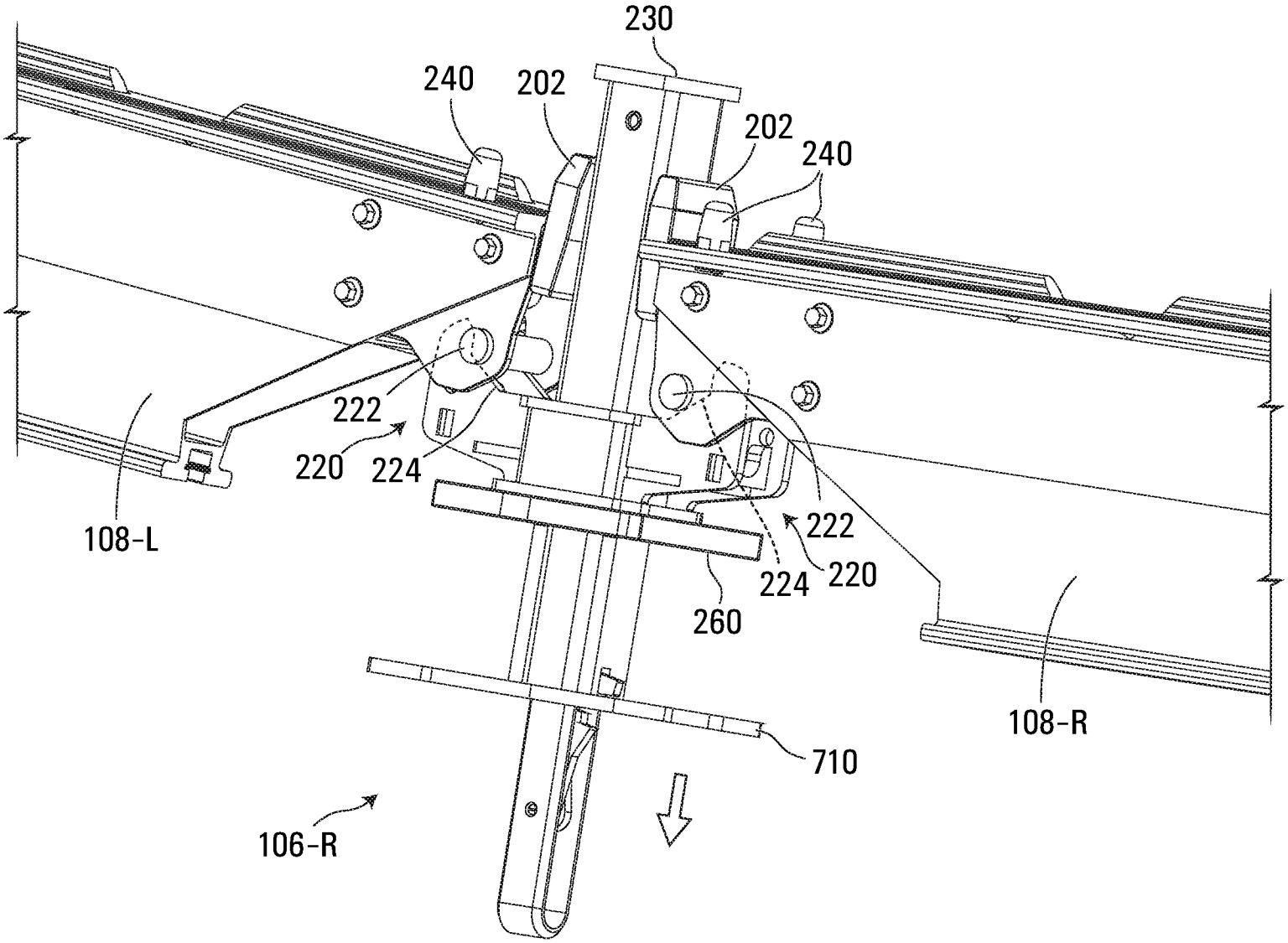
FIG. 2D is a side-perspective view of the formwork system 100.

Reference is made to FIGS. 2C and 2D, illustrating beams 108-L, 108-R and support head 106-R. In FIGS. 2C and 2D, support arm 220 of support head 106-R has been moved down vertically relative to its position in FIGS. 2A and 2B; thus, both beams 108-L, 108-R are sloping up relative to support head 106-R. The beams 108 now create a 'valley'.

Support arm 220 of support head 106 may be moved vertically downwards by adjusting the height of a vertical prop upon which support head 106 is mounted. Alternatively, support arm 220 may be vertically movable relative to central upstanding member 230.

The decrease in the height of support head 106-R also causes transverse bars 222 (shown in phantom) resting on inclined portions 224 of support head 106-R to move laterally away from central upstanding member 230 along the inclined portion 224. While in FIGS. 2A and 2B (when the beams are level) transverse bar 222 is supported approximately at the middle of inclined portion 224 of support arm 220, in FIGS. 2C and 2D (when the beams are sloping up), transverse bar 222 is supported near the top of inclined portion 224 of support arm 220 at the position furthest from central upstanding member 230.

Furthermore, in FIGS. 2C and 2D, foot 202 is no longer substantially perpendicular to central upstanding member 230. In FIGS. 2C and 2D, when beams 108-L, 108-R are sloping up relative to support head 106-R, foot 202 partially abuts central upstanding member 230 such that only an upper portion of foot 202 abuts central upstanding member 230.

In addition, the gap between forming panels 102 supported by beam 108-L and forming panels 102 supported by beam 108-R is relatively smaller when beams 108 are sloping up relative to support head 106-R (FIG. 2C) compared to when beams 108 are level (FIGS. 2A and 2B). Notably, however, since the beams moved both laterally and vertically when support arm 220 was moved down, the difference in the gap size is reduced.

Figure 2E:
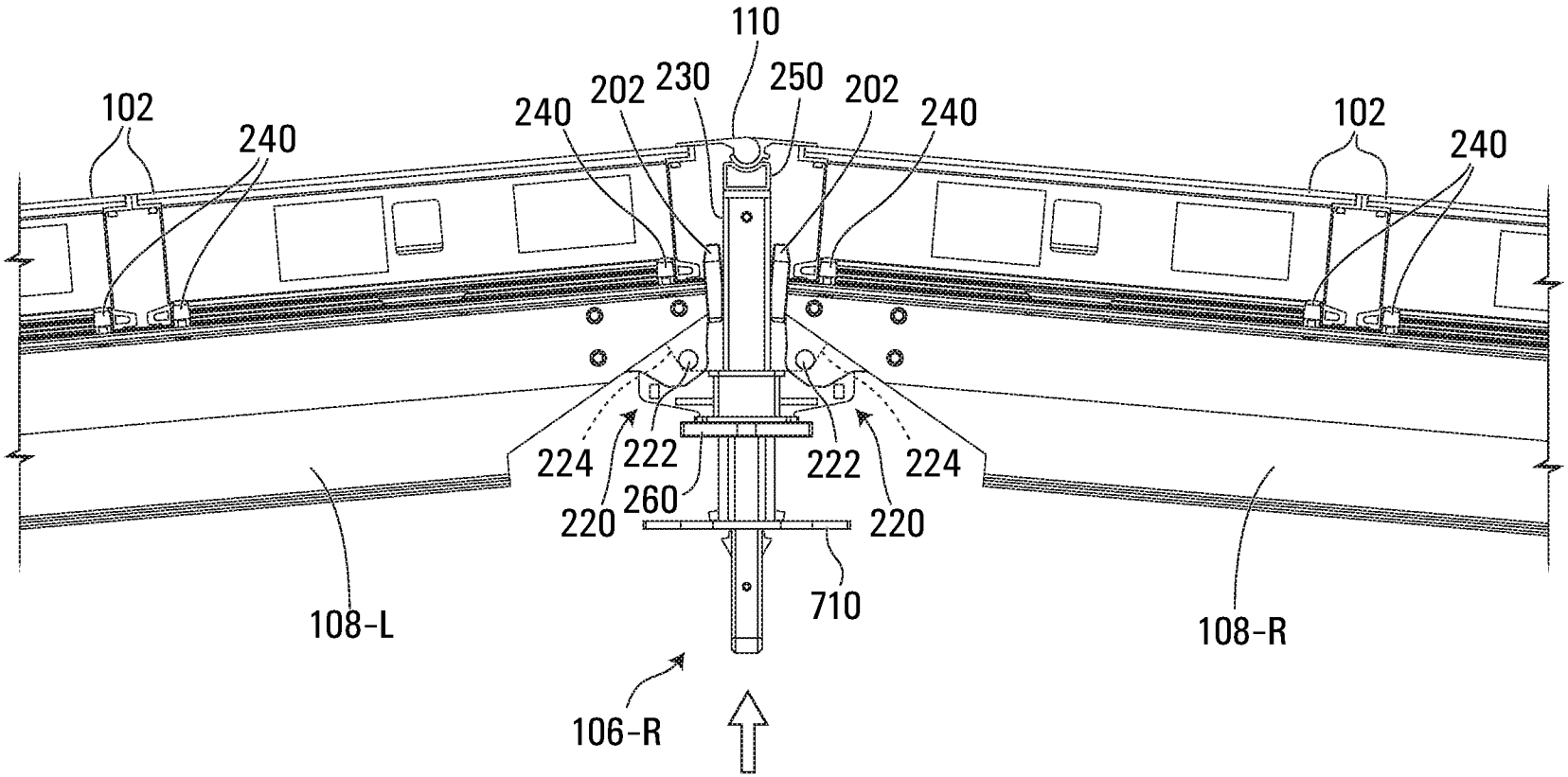

Reference is made to FIG. 2E illustrating beams 108-L, 108-R and support head 106-R. In FIG. 2E, support arm 220 of support head 106-R has been moved vertically upwards relative to its position in FIGS. 2A and 2B; thus, both beams 108-L, 108-R are sloping down relative to support head 106-R. The beams 108 now create a 'peak'.

Further the increase in the height of support head 106-R also causes transverse bars 222 (shown in phantom) resting on inclined portions 224 of support arm 220 to move laterally towards central upstanding member 230 along the inclined portion 224. While in FIGS. 2A and 2B (when the beams are level) transverse bar 222 is supported approximately at the middle of inclined portion 224 of support arm 220, in FIG. 2E (when the beams are sloping down), transverse bar 222 is supported near the bottom of inclined portion 224 of support arm 220 at the position closest to central upstanding member 230.

Furthermore, in FIG. 2E, foot 202 is also no longer substantially perpendicular to central upstanding member 230. In FIG. 2E, when beams 108-L, 108-R are sloping down from support head 106-R, foot 202 partially abuts central upstanding member 230 such that only a lower portion of foot 202 abuts central upstanding member 230.

In some embodiments, the abutment surface of lower portion of foot 202 may be tapered (FIG. 9F) such that beam 108 can move more closely towards central upstanding member 230 when the beam is sloping down from support head 106-R.

In addition, the gap between forming panels 102 supported by beam 108-L and forming panels 102 supported by beam 108-R is relatively larger when beams 108 are sloping down relative to support head 106-R (FIG. 2E) compared to when beams 108 are level (FIGS. 2A and 2B). Notably, however, since the beams moved both laterally and vertically when support arm 220 was moved up, the difference in the gap size is reduced.

Figure 2F:
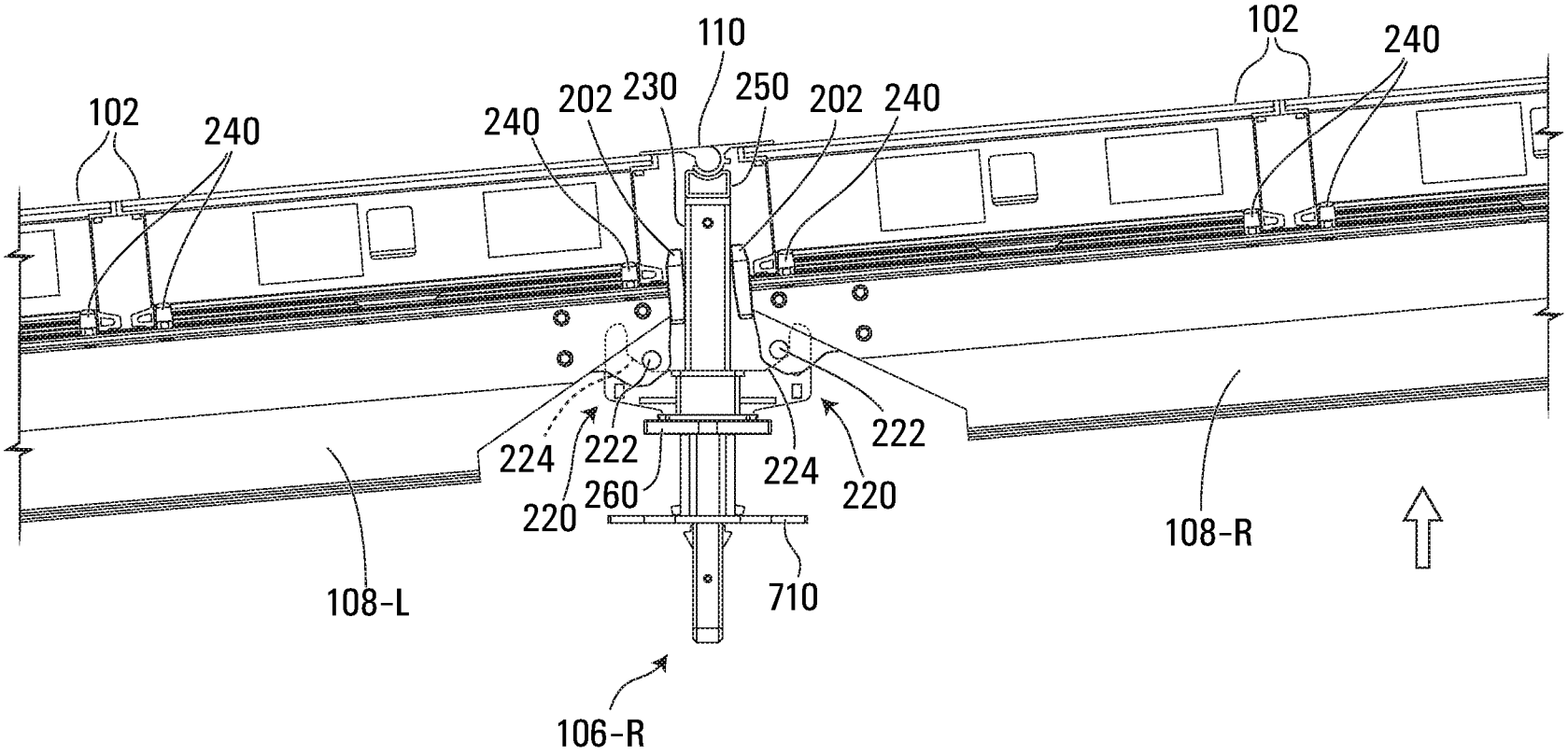
Figure 3A:
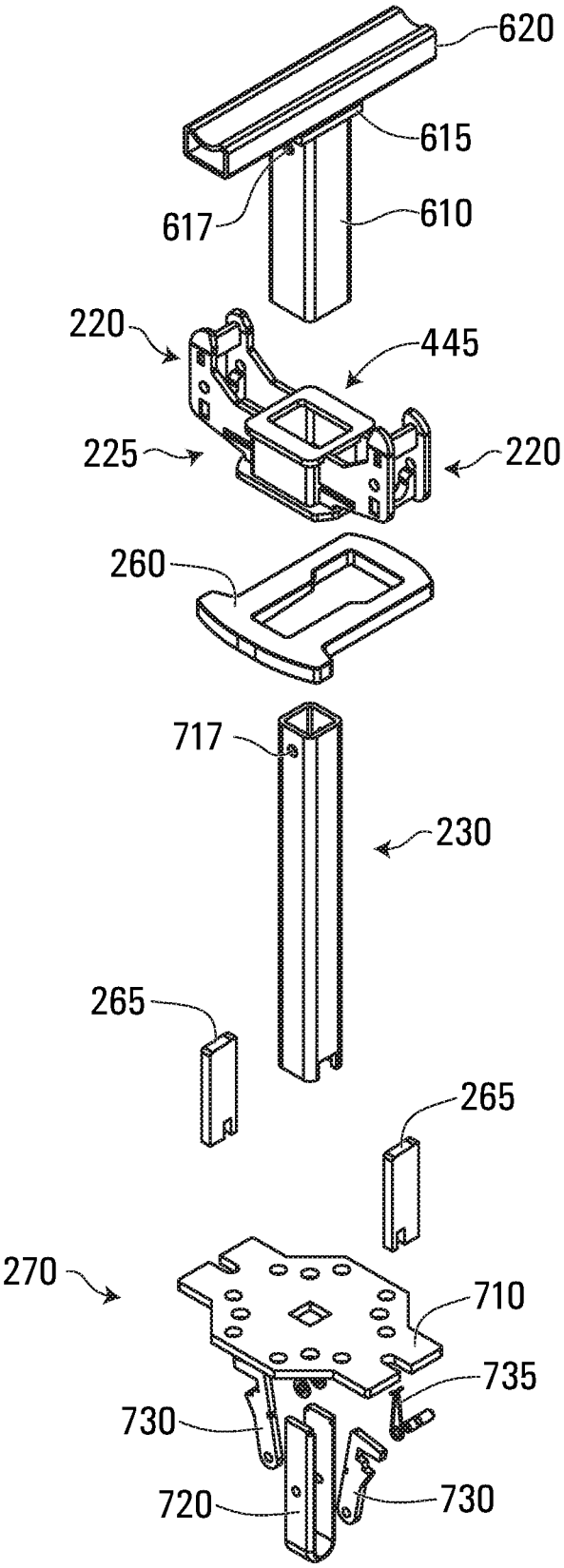
FIG. 3A is an exploded view of a support for use with the formwork system 100 in accordance with an example embodiment.
Figure 3E:
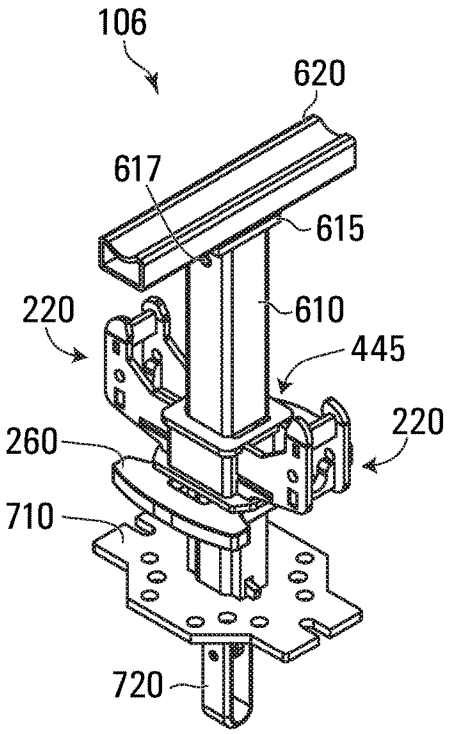
FIG. 3E is a top-perspective view of the support of FIG. 3A.
Figure 3D:
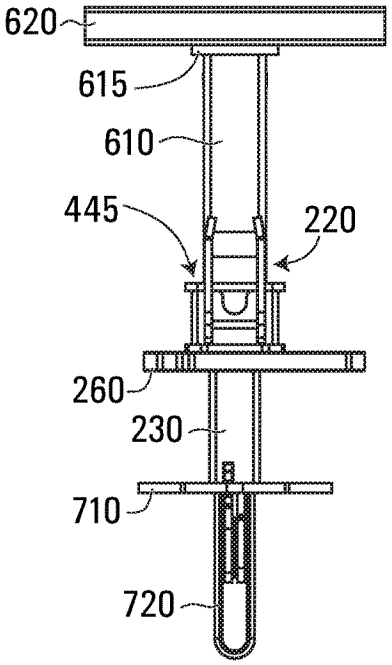
FIG. 3D is a second side view of the support of FIG. 3A.
Figure 3B:
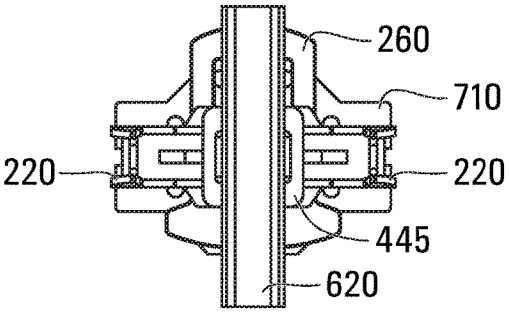
FIG. 3B is an top view of a support of FIG. 3A.
Figure 3C:
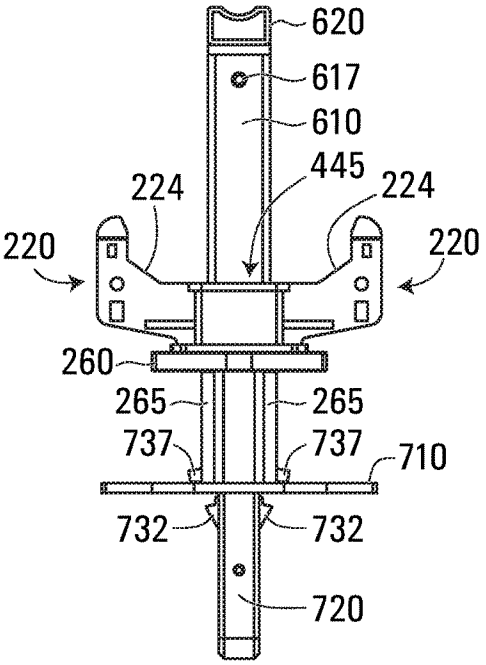
FIG. 3C is a side view of the support of FIG. 3A.
Figure 4D:
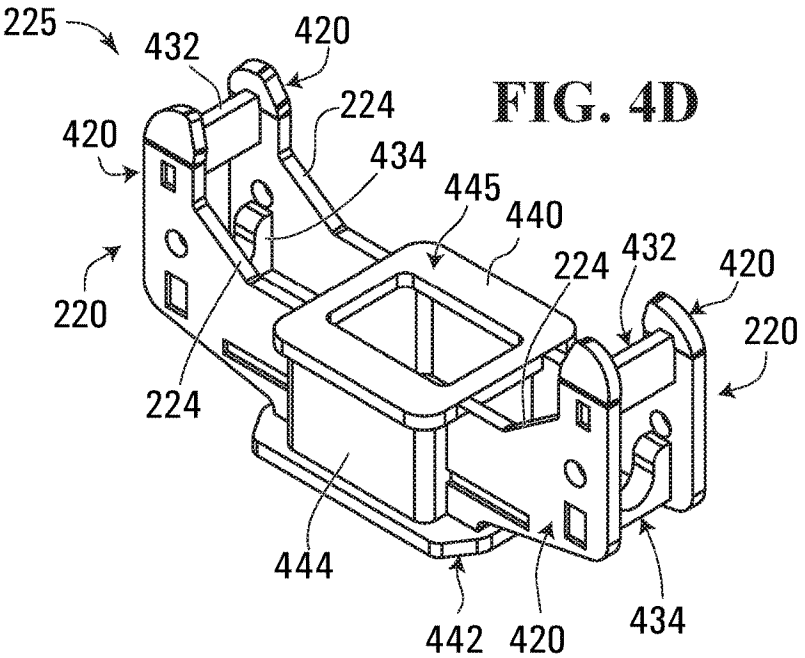
FIG. 4D is a top-perspective side view of the support head of FIG. 4A.
Figure 4C:
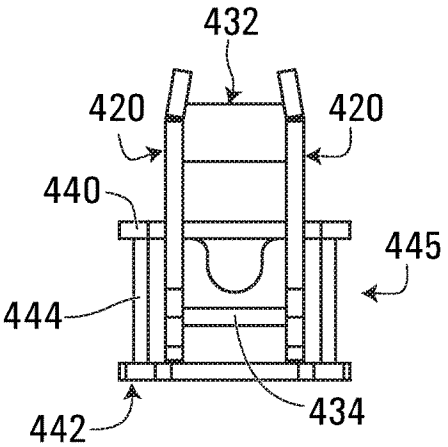
FIG. 4C is a second side view of the support head of FIG. 4A.
Figure 4A:
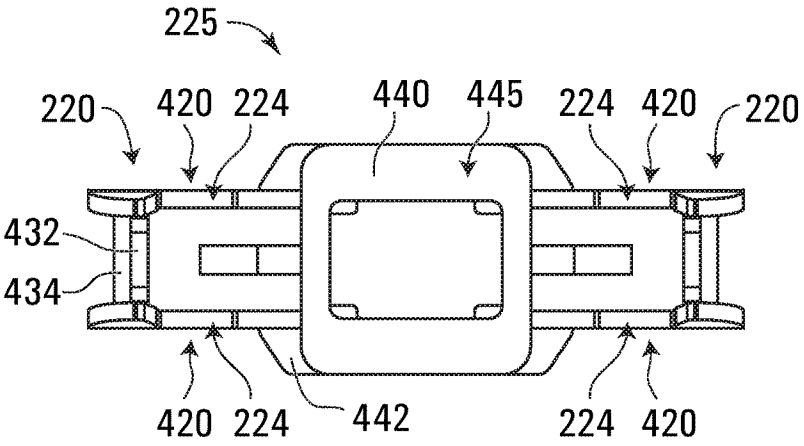
FIG. 4A is a top view of a support head for use with the support of FIG. 3A in accordance with an example embodiment.
Figure 4B:
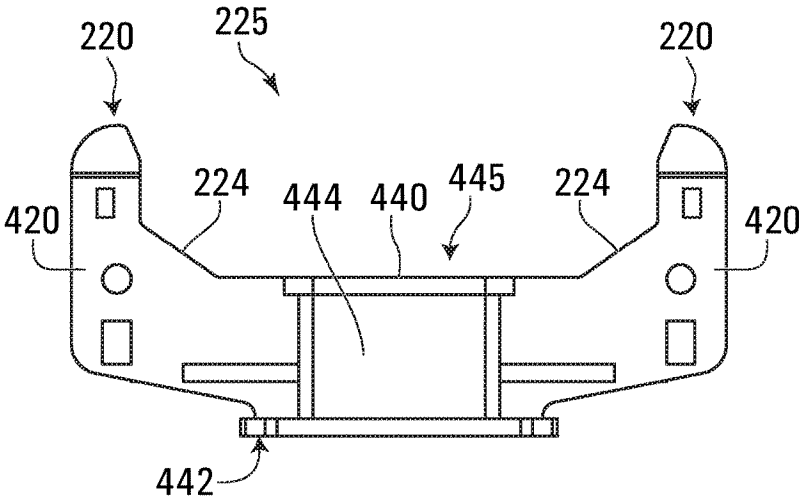
FIG. 4B is a side view of the support head of FIG. 4A.

Reference is made to FIG. 2F illustrating beams 108-L, 108-R and support head 106-R. In FIG. 2F, support arm 220 of support head 106-R is in the same vertical position as in FIG. 2E, but the second support head (not shown) supporting beam 108-R has been moved vertically upwards relative to its position in FIG. 2E. Thus, beam 108-L is sloping down from support head 106-R whereas beam 108-R is sloping up relative to support head 106-R. The beams 108 now create a 'ramp'.

Further, the increase in the height of the second support arm (not shown) also causes transverse bar 222 (shown in phantom) of beam 108-R resting on inclined portions 224 of support head 106-R to move laterally away from central upstanding member 230 along the inclined portion 224. While in FIG. 2E transverse bar 222 of beam 108-R is supported near the bottom of inclined portion 224 of support arm 220 (at the position closest to central upstanding member 230), in FIG. 2F transverse bar 222 of beam 108-R is supported near the top of inclined portion 224 of support arm 220 (at the position furthest from central upstanding member 230).

Furthermore, in FIG. 2F, lower portion of foot 202 of beam 108-R is no longer abutting central upstanding member 230. Instead, only upper portion of foot 202 of beam 108-R partially abuts central upstanding member 230.

In addition, the gap between forming panels 102 supported by beam 108-L and forming panels 102 supported by beam 108-R is relatively smaller in FIG. 2F compared to in FIG. 2E.

Thus, an increase in the height of a support arm 220 supporting a transverse bar 224 of a beam 108 results in lateral movement of the transverse bar 222 along the inclined portion 224 of the support arm 220 towards central upstanding member 230 and further results in lateral movement of the beam 108 towards central upstanding member 230. Further, any forming panels 102 resting on beam 108 which are laterally secured by protrusions 240 will move laterally along with beam 108.

Similarly, a decrease in the height of a support arm 220 supporting a transverse bar 224 of a beam 108 results in lateral movement of the transverse bar 222 along the inclined portion 224 of the support arm 220 away from central upstanding member 230 and further results in lateral movement of the beam 108 away from central upstanding member 230. Further, any forming panels 102 resting on beam 108 which are laterally secured by protrusions 240 will move laterally along with beam 108.

In other words, each support arm 220 of formwork system 100 acts as a shifting pivot point for beams 108. Beam 108 moves laterally when pivoted about support arm 220 (in addition to moving vertically). Since beams 108 have a fixed length, pivoting one end of a beam 108 about a fixed point would result in a lateral shift of the opposite end of beam 108. However, in formwork system 100 beams 108 moves laterally when pivoted; thus, the lateral shift of the opposite end of beam 108 is reduced.

In one embodiment, an increase in the height of a support arm 220 by approximately 200 to 220 mm will result in a lateral movement of transverse bar 222 along inclined portion 224 of the support arm 220 towards central upstanding member 230 by approximately 9.5 mm. In addition, transverse bar 222 will move down vertically along inclined portion 224 by approximately 4.5 mm. Further, the increase in height will cause beam 108 to incline down from support head 106 at an angle of 5 degrees.

In one embodiment, a decrease in the height of a support arm 220 by approximately 200 to 220 mm will result in a lateral movement of the transverse bar 222 along the inclined portion 224 of the support arm 220 away from central upstanding member 230 by approximately 7 mm. In addition, transverse bar 222 will move up vertically along inclined portion 224 by approximately 7 mm. Further, the increase in height will cause beam 108 to incline up relative to support head 106 at an angle of 5 degrees.

Reference is now made to FIGS. 3A-3E, showing an example embodiment of support head 106 in isolation. As will be explained in greater detail, support head 106 has a support arm block 225 including support arm(s) 220, a base portion 270 for mounting support head 106 on a vertical prop (not shown), a release wedge 260 and side plates 265 allowing support head 106 to function as a 'drop-head' (as will be explained later), and an upper support 250 for supporting a compensation-strip 110. In one embodiment, support head 106 extends by approximately 500 mm from the top of upper support 250 to the bottom of base portion 270.

Central upstanding member 230 is an elongate member. For example, in one embodiment, central upstanding member 230 is approximately 40 mm long, 40 mm wide and 340 mm tall. In one embodiment, central upstanding member 230 is made of a metallic material, such as aluminum or steel. In one embodiment, central upstanding member 230 is hollow.

In one embodiment, central upstanding member 230 has side plates 265 attached at a bottom portion thereof to increase the thickness of the bottom portion of central upstanding member 230. In one embodiment, each side plate 265 is 10 mm thick, thereby increasing the thickness of the bottom portion of central upstanding member 230 to 60 mm.

One example embodiment of support arm block 225 of support head 106 is illustrated in isolation in FIGS. 4A-4D. Support arm block 225 has a central block 445, formed by an upper base plate 440 and a lower base plate 442 separated by a vertical plates 444. Each of upper base plate 440 and lower base plate 442 has a void in the center thereof. Support arm block 225 receives central upstanding member 230 through the voids in upper and lower base plates 440, 442 and may be vertically moveable relative to central upstanding member 230 (See FIGS. 3A-3E).

In one embodiment, each of upper and lower base plates 440, 442 is approximately 80 mm×80 mm in size. In one embodiment, the void of of upper base plate 440 is approximately 60 mm×60 mm in size and the void of lower base plate 442 is approximately 60 mm×41 mm in size. Further, in one embodiment, central upstanding member 230 is marginally smaller in size than the void of lower base plate 442 (for example, 40 mm×40 mm in size), such that support arm block 225 can move vertically relative to central upstanding member 230.

In one embodiment, the plates of support arm block 225 are made of a metallic material, such as aluminum or steel. The plates may be secured to one another by welding.

In one embodiment, support arm block 225 includes two support arms 220, mounted at opposing sides of support arm block 225. In one embodiment, the distance between the two support arms 220 is approximately 200 mm.

Each support arm 220 may include two opposing side plates 420, which are separated by upper and lower spacers 432, 434. Thus, the two opposing side plates 420, when placed side-by-side, separated by spacers 432, 434, provide inclined portion 224 and flat portion 226 (FIG. 1C) upon which transverse bar 222 of beam 108 may be supported.

Side plates 420 and upper and lower spacers 432, 434 may be made of a metallic material, such as aluminum or steel. Side plates 420 may interlock with central block 445 of support arm block 225. In one embodiment, side plates 420 may also be welded to upper and lower spacers 432, 434 and to central block 445. In one embodiment, support arms 220 are welded to central block 445.

Figure 5A:
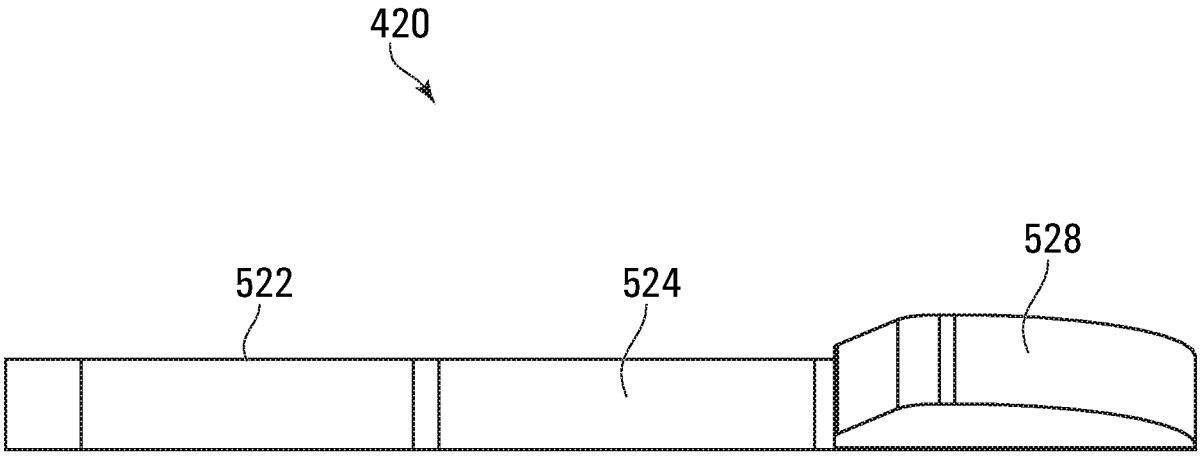
FIG. 5A is a top view of a side plate for use with the support head of FIG. 4A in accordance with an example embodiment.
Figure 5B:
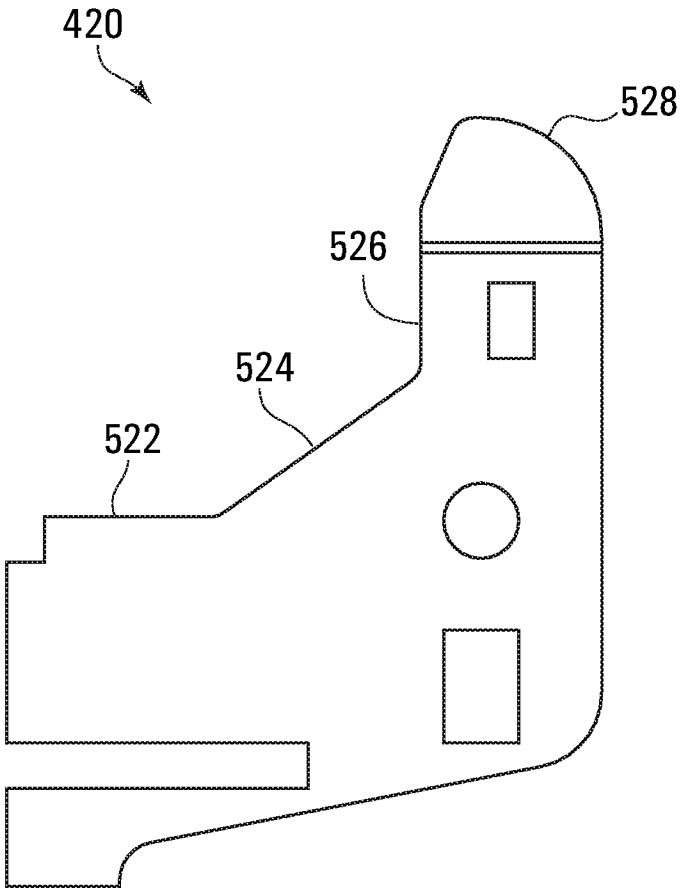
FIG. 5B is a side view of the side plate of FIG. 5A.
Figure 5C:
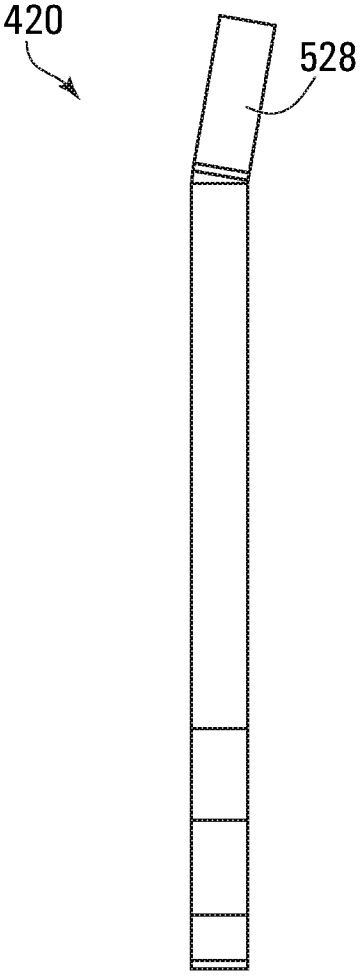
FIG. 5C is a second side view of the side plate of FIG. 5A.

One example embodiment of a side plate 420 of support arm 220 of support arm block 225 is illustrated in isolation in FIGS. 5A-5C. Notably, as shown, each side plate 420 has a flat/horizontal portion 522 which extends away from central block 445 (and central upstanding member 230), an inclined portion 524 which extends up and away from flat/horizontal portion 522, and a vertical portion 526 extending upwardly from inclined portion 524.

In one embodiment, flat/horizontal portion 522 may limit the range of travel of transverse bar 222, thereby making assembly of formwork system 100 more convenient. In one embodiment, flat portion 522 may extend 25 to 35 mm away from central block 445.

As previously discussed, inclined portion 524 provides the inclined portion 224 upon which transverse bar 222 of beam 108 is supported. In one embodiment, as shown, inclined portion 524 is a straight incline. Further, in one embodiment, inclined portion 524 may be inclined at an angle ranging from 30 to 40 degrees. As shown, inclined portion 524 is inclined at a 35 degree angle. Further, in one embodiment, inclined portion 524 may extend 25 to 35 mm away from flat portion 522.

In one embodiment, inclined portion 524 is approximately 30 mm in length. The length of inclined portion 524 may be modified to alter the maximum incline angle of beams 108. In one embodiment, an inclined portion 524 allows the beams to incline up or down by 5 degrees.

In other embodiments, the inclined portion may be curved (not shown). For example, the inclined portion may take the shape of a quadratic which extends up and away from flat portion 522.

In other embodiments, the inclined portion may be jagged (not shown). For example, the inclined portion may include multiple steps upon which transverse bar 222 of beam 108 may be supported. Notably, however, a jagged inclined portion may be more difficult to use as transverse bar 222 may not slide easily up along the jagged inclined portion.

Vertical portion 526 may be helpful in preventing transverse bar 222 from rolling off inclined portion 524 when only one end of beam 108 is supported, and thus also prevents beam 108 from falling. In one embodiment, vertical portion 526 extends up by 10 to 20 mm from the top of inclined portion 524.

In one embodiment, each side plate 420 also has a tapered end 528 extending upwardly from vertical portion 526. Tapered end 528 may have a tapered slope extending from vertical portion 526, which may help direct transverse bar 222 towards inclined portion 524 of side plate 420. Further, in one embodiment, the outer edge of tapered end 528 may be curved to minimize sharp edges and reduce the likelihood of injury to a worker.

In some embodiments, tapered end 528 has a width ranging from 20 to 30 mm and a height ranging from 15 to 22 mm. In some embodiments, tapered end 528 is also angled in towards the opposing side plate 420 (see FIGS. 4C and 5C). In some embodiments, tapered end 528 is angled in at an angle ranging from 5 to 15 degrees (10 degrees, as shown). In one embodiment, tapered end 528 is angled by deforming a portion of plate 420.

An example embodiment of upper support 250 for supporting a compensation-strip 110 is shown in isolation in FIGS. 6A-6F. Upper support 250 is mounted at the top of support head 106 such that when compensation-strip 110 is supported on upper support 250, compensation-strip 110 is level with forming panels 102 adjacent to the compensation-strip 110.

Figure 6A:
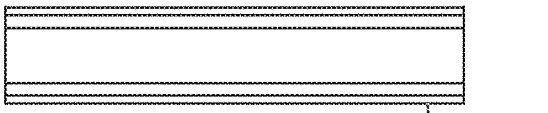
FIG. 6A is a top view of a support element for use with the support of FIG. 3A in accordance with an example embodiment.
Figure 6B:
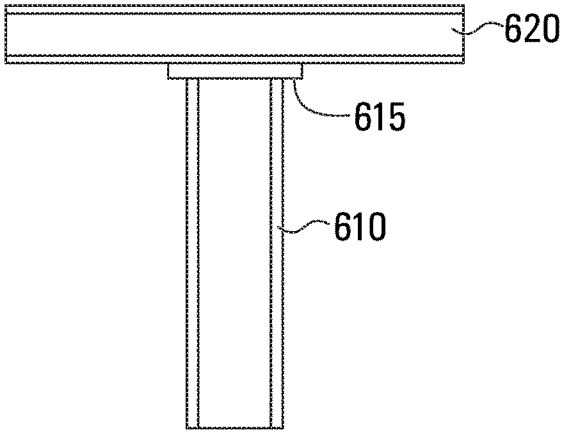
FIG. 6B is a side view of the support element of FIG. 6A.
Figure 6C:
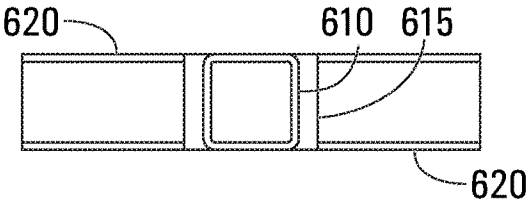
FIG. 6C is a bottom view of the support element of FIG. 6A.
Figure 6D:
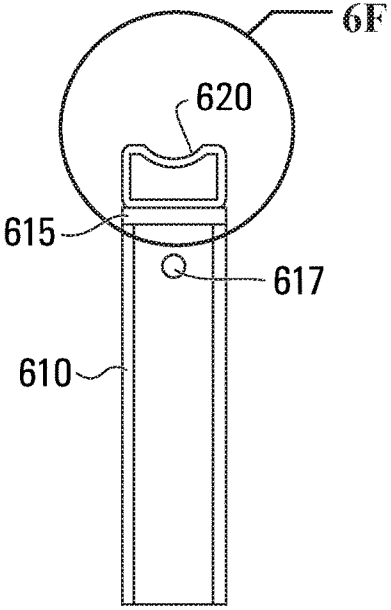
FIG. 6D is a second side view of the support element of FIG. 6A.
Figure 6E:
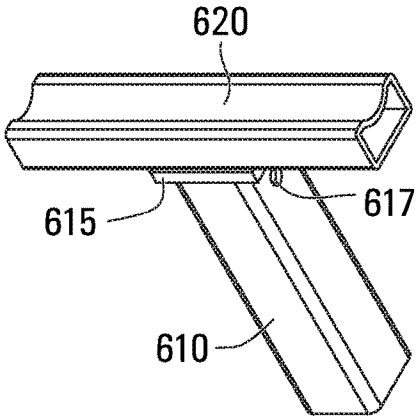
FIG. 6E is a top-perspective view of the support element of FIG. 6A.
Figure 6F:
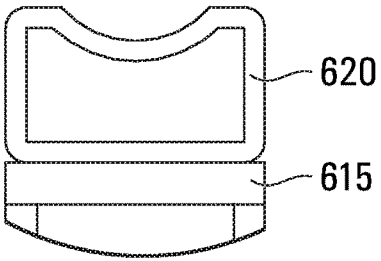
FIG. 6F is partial close-up view of the support element of FIG. 6A.

In one embodiment, as shown in FIGS. 6B, 6D, and 6E, upper support 250 is T-shaped, having an upper cross-member 620, a support plate 615 for supporting upper cross-member 620, and a vertical member 610. In one embodiment, the components of upper support 250 are made of a metallic material, such as aluminum or steel.

In one embodiment, vertical member 610 is hollow and is larger in size than upstanding member 230, such that vertical member 610 maybe inserted over central upstanding member 230, as shown in FIGS. 3A-3E. In one embodiment, vertical member 610 is approximately 70 mm long, 50 mm wide and 180 mm tall. In contrast, central upstanding member 230 is smaller in size (for example, 40 mm×40 mm in size).

In one embodiment, vertical member 610 includes a through-hole 617 and central upstanding member 230 includes a corresponding through-hole 717. Through-hole 617 and through-hole 717 are aligned when vertical member 610 is inserted over central upstanding member 230. To removably secure the two members to one another, a pin or screw (not shown) may be inserted into through-hole 617 of vertical member 610 of upper support 250 and into corresponding through-hole 717 (FIG. 3A) of central upstanding member 230.

In one embodiment, support plate 615 is secured to the top of vertical member 610 (for example, by welding, with a screw, or otherwise). Support plate 615 has a width corresponding to the width of upper cross-member 620, which is then secured to support plate 615 (for example, by welding, with a screw, or otherwise). In one embodiment, upper cross-member 620 has a width of 50 mm and is 240 mm long.

In one embodiment, once mounted, upper cross-member 620 is the top point of support head 106 (FIG. 3A-3E). Upper cross-member 620 is configured (for example, shaped) to support a central hinge portion of a compensation-strip 110. The central hinge portion of a compensation-strip 110 may rest on upper cross-member 620 without being secured thereto (FIGS. 11A-11D). In one embodiment, upper cross-member 620 has a top surface that has a corresponding shape to the central hinge portion of compensation-strip 110. For example, the top surface of upper cross-member 620 may be curved to accommodate the central hinge portion of compensation-strip 110.

Reference is made to FIGS. 7A-7F, showing an example embodiment of a base portion 270 of support head 106. Base portion 270 allows for mounting support head 106 on a vertical prop. Base portion 270 includes a base plate 710 (FIG. 7A) for securing support head 106 to a vertical prop, a U-shaped member 720 (FIGS. 7C-7F), and hinged hooks 730 (FIGS. 7C-7G). In one embodiment, the components of base portion 270 are made of a metallic material, such as aluminum or steel.

Figure 7A:
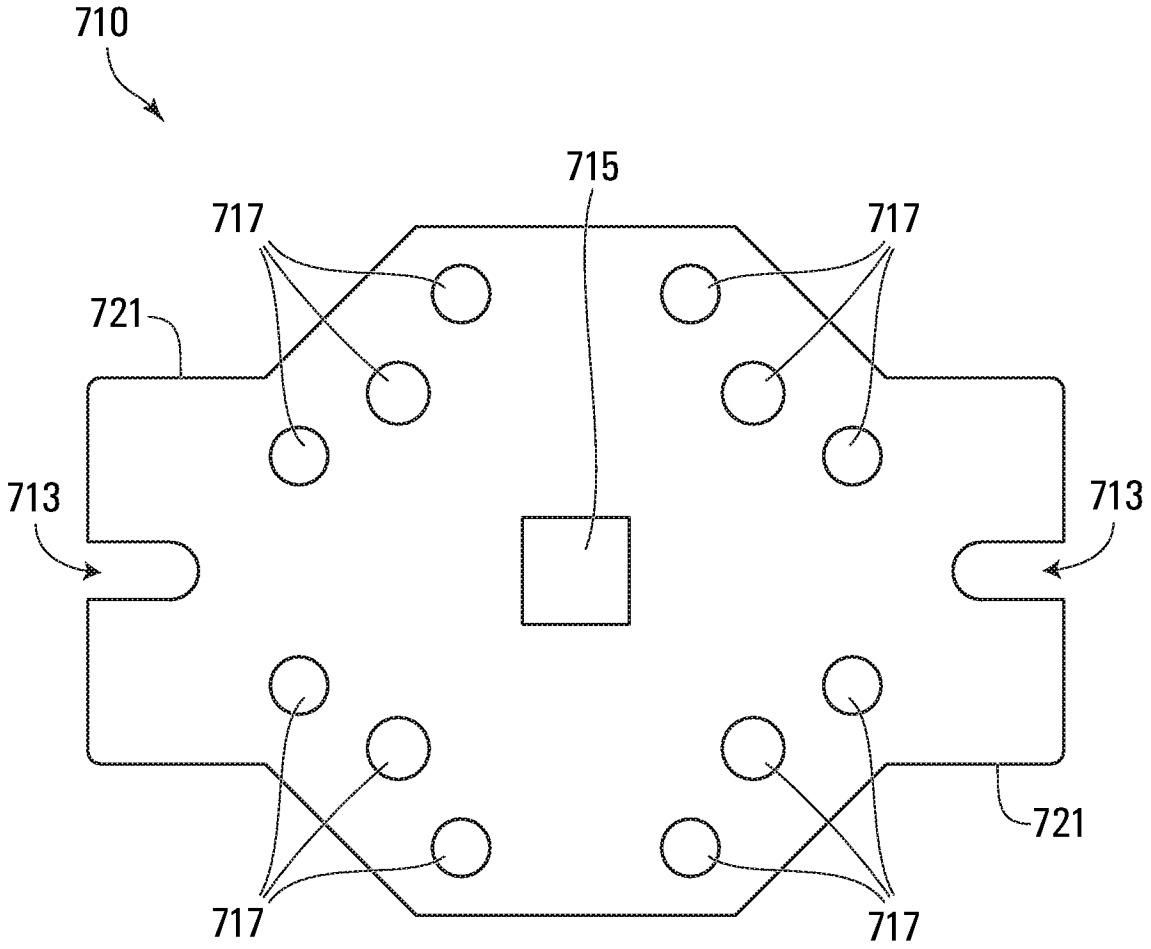
FIG. 7A is top view of a base plate for use with the support of FIG. 3A in accordance with an example embodiment.
Figure 7B:
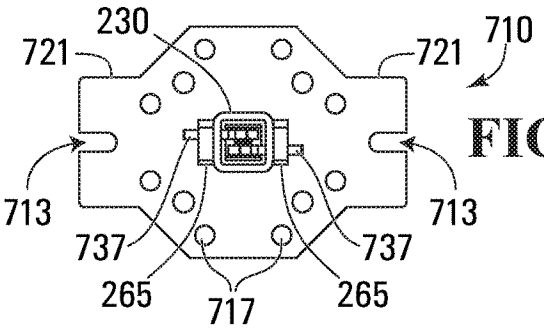
FIG. 7B is a top view of a base portion for use with the support of FIG. 3A in accordance with an example embodiment.
Figure 7F:
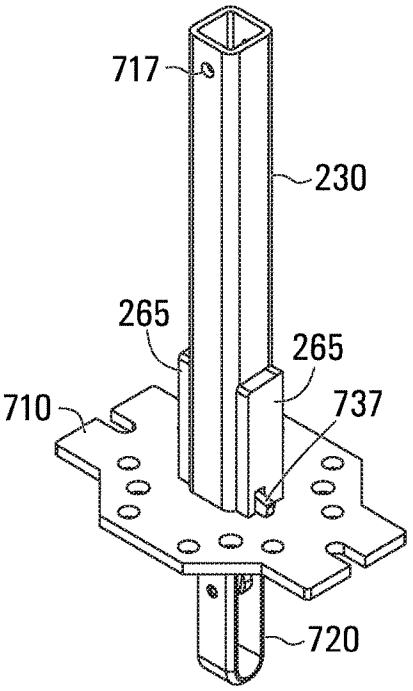
FIG. 7F is a top-perspective view of the base portion of FIG. 7B.
Figure 7E:
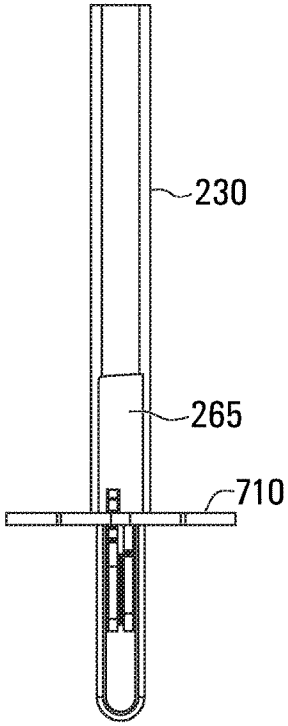
FIGS. 7C-7E are side views of the base portion of FIG. 7B.
Figure 7D:
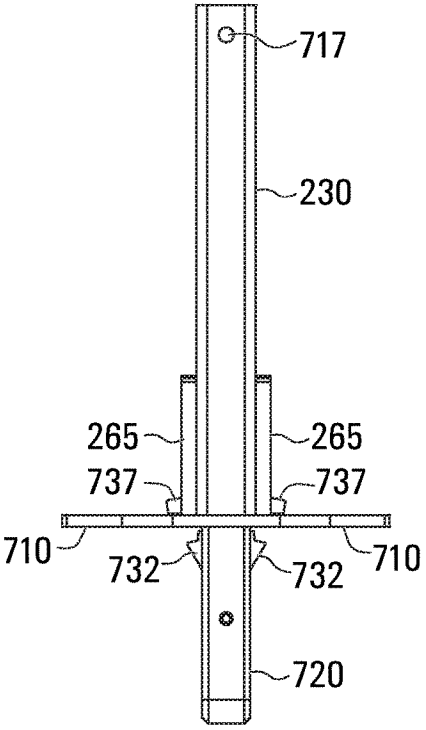
Figure 7C:
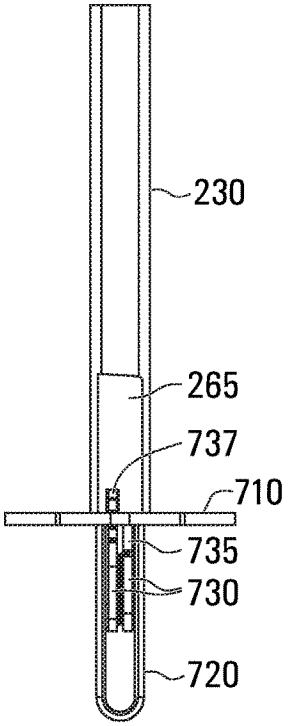
Figure 7G:
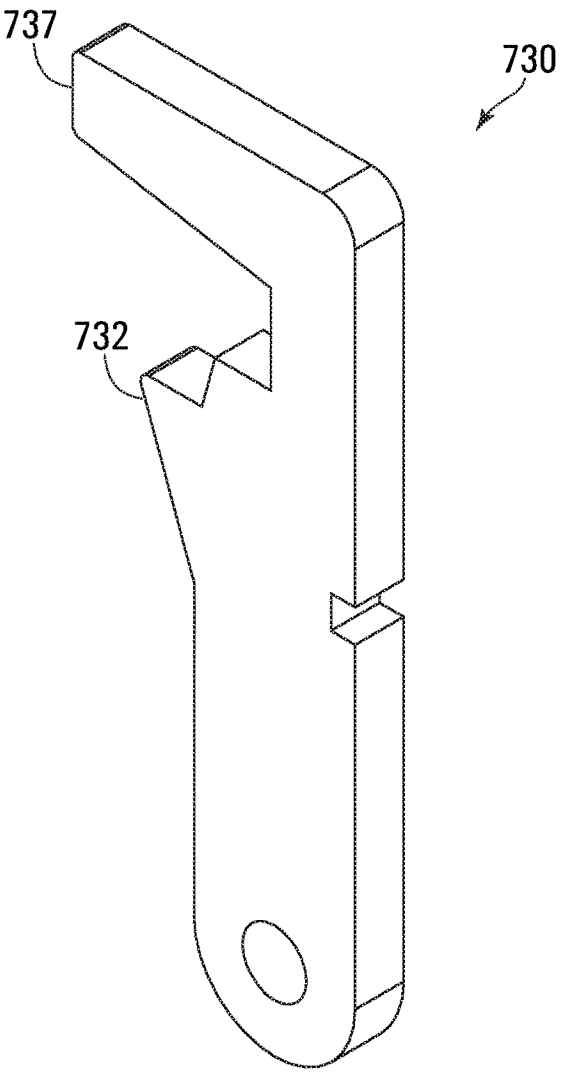
FIG. 7G is a top-perspective view of a hook for use with the base portion of FIG. 7B in accordance with an example embodiment.

Base plate 710 may have a central void 715 (FIG. 7A). In one embodiment, central void 715 is approximately 25 mm in width and 25 mm in length.

A bottom portion of central upstanding member 230 may be secured to an upper side of base plate 710 at central void 715, for example, by welding. Similarly, the top of U-shaped member 720 may be secured to a lower side of base plate 710 at central void 715, for example, by welding.

Base plate 710 may also be shaped to prevent beams from hitting support 105 which supports the beam. As shown in FIG. 7A, base plate 710 has extension portions 721 on each side thereof. In use, extension portions 721 are aligned with beams 108. Thus, when only one end of beam 108 is supported, extension portions 721 may provide a barrier preventing the beam 108 from hitting the base portion 104 of support 105. In one embodiment, extension portions 721 extend by approximately 100 mm in each direction from the center of base plate 710.

In one embodiment, base portion 270 may be removably mounted on top of a vertical prop (not shown). To allow for mounting, base plate 710 has notches 713 at each side thereof and through-holes 717 (FIG. 7A), which may provide convenient points to screw base plate 710 to the top of a vertical prop (not shown). Further, U-shaped member 720 may extend below base plate 710, and may be received in a void (not shown) of vertical prop (not shown) for added stability. In one embodiment, U-shaped member 720 has a height of approximately 130 mm.

In one embodiment, U-shaped member 720 may be omitted from support head 106 to allow support head 106 to be mounted on a vertical prop having no corresponding void.

Figure 7H:
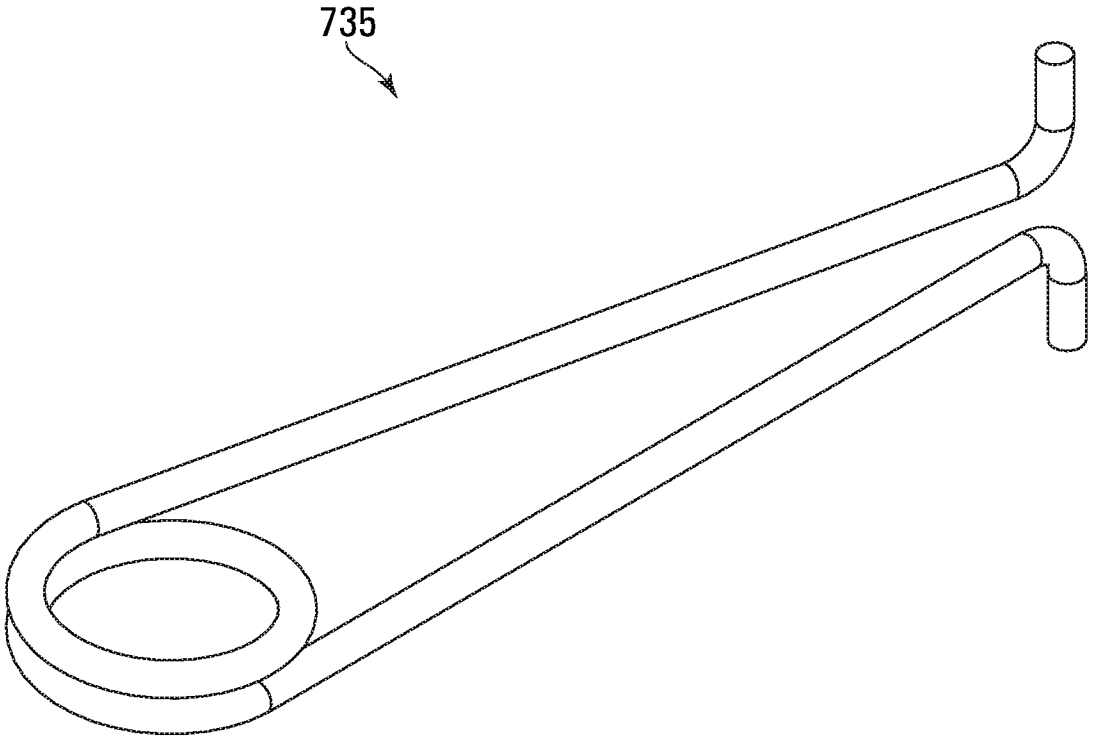
FIG. 7H is a top-perspective view of a spring for use with the base portion of FIG. 7B in accordance with an example embodiment.

In one embodiment, U-shaped member 720 has attached thereto a pair of hinged hooks 730 (FIG. 7G) and a spring 735 (FIG. 7H). Hinged hooks 730 are oriented in opposite directions and help secure base portion 270 to the top of a vertical prop (not shown). Spring 735 applies pressure on each of hinged hooks 730, causing the hinged hooks 730 protrude outwardly, pressing against the interior of a void of vertical prop which receives U-shaped member 720.

Each hinged hook 730 has a top notch 737 and a bottom notch 735. Bottom notches 735 are configured to engage the interior of the void of vertical prop (not shown) which receives U-shaped member 720, whilst top notches 737 protrude through central void 715 of base plate 710 and further protrude through notches in central upstanding member 230 and side plates 265 (FIGS. 7C-7F).

To remove support head 106 from a vertical prop (not shown), top notches 737 may be struck to de-engage the bottom notches from pressing the interior of the void of vertical prop. Hinged hooks 730 may thus, in some embodiments, allow for attachment and detachment of support head 106 without the use of screws and bolts.

Reference is made to FIGS. 8A-8D, illustrating an example embodiment of a release wedge 260 in isolation. Release wedge 260, in conjunction with side plates 265, allows support head 106 to function as a drop-head. In one embodiment, release wedge 260 is approximately 180 mm long, 140 mm wide and 15 mm thick. In one embodiment, release wedge 260 is made of a metallic material, such as aluminum or steel.

As is known in the art, liquid concrete is first poured onto forming panels 102 supported by beams 108 and supports 105. Concrete sets and cures slowly over time and may take a few days to set and several weeks to fully cure. Forming panels 102 can usually be removed within a matter of days provided that supports 105 are maintained to support the concrete for a longer time (for example, a week or more, depending on the conditions). Early removal of forming panels 102 and beams 108 may reduce construction costs, as the same parts can be re-used to form higher floors. Thus, in example embodiments, support head 106 may include a release wedge 260 to allow for releasing forming panels 102 and beams 108 prior to removing supports 105.

Figure 8A:
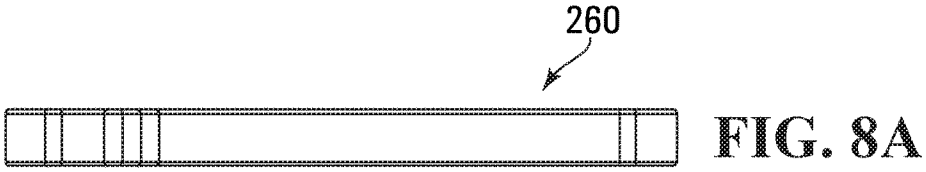
FIG. 8A is a side view of a release wedge for use with the support of FIG. 3A in accordance with an example embodiment.
Figure 8D:
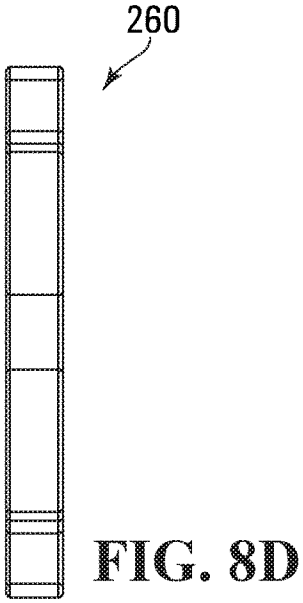
FIG. 8D is a second side view of the support element of FIG. 8A.
Figure 8B:
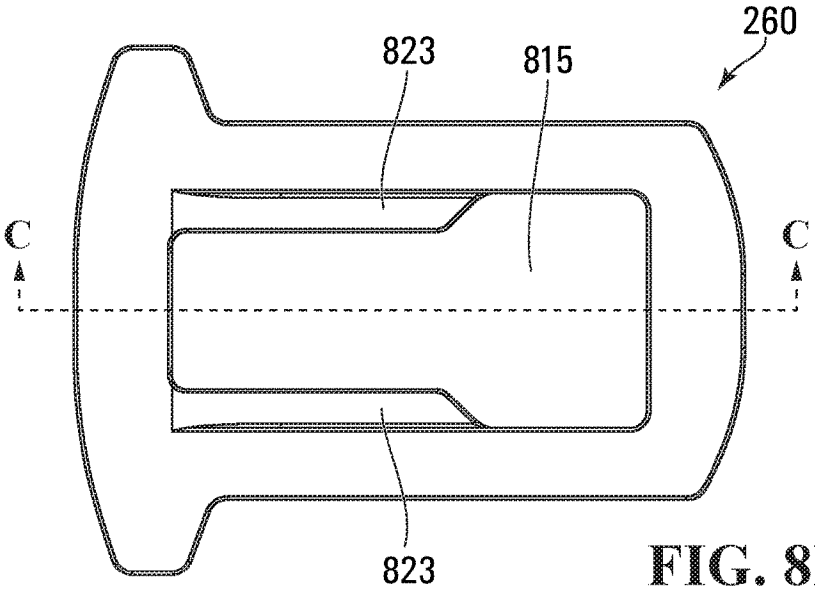
FIG. 8B is a top view of the release wedge element of FIG. 8A.
Figure 8C:
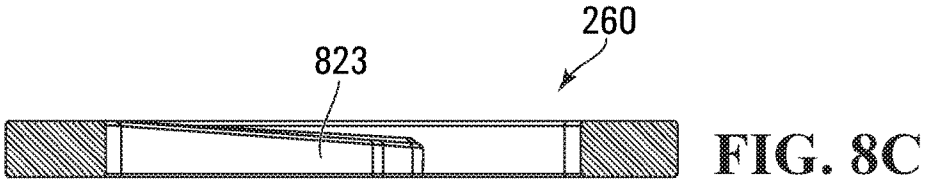
FIG. 8C is a cross-section view of the support element of FIG. 8A.
Figure 8E:
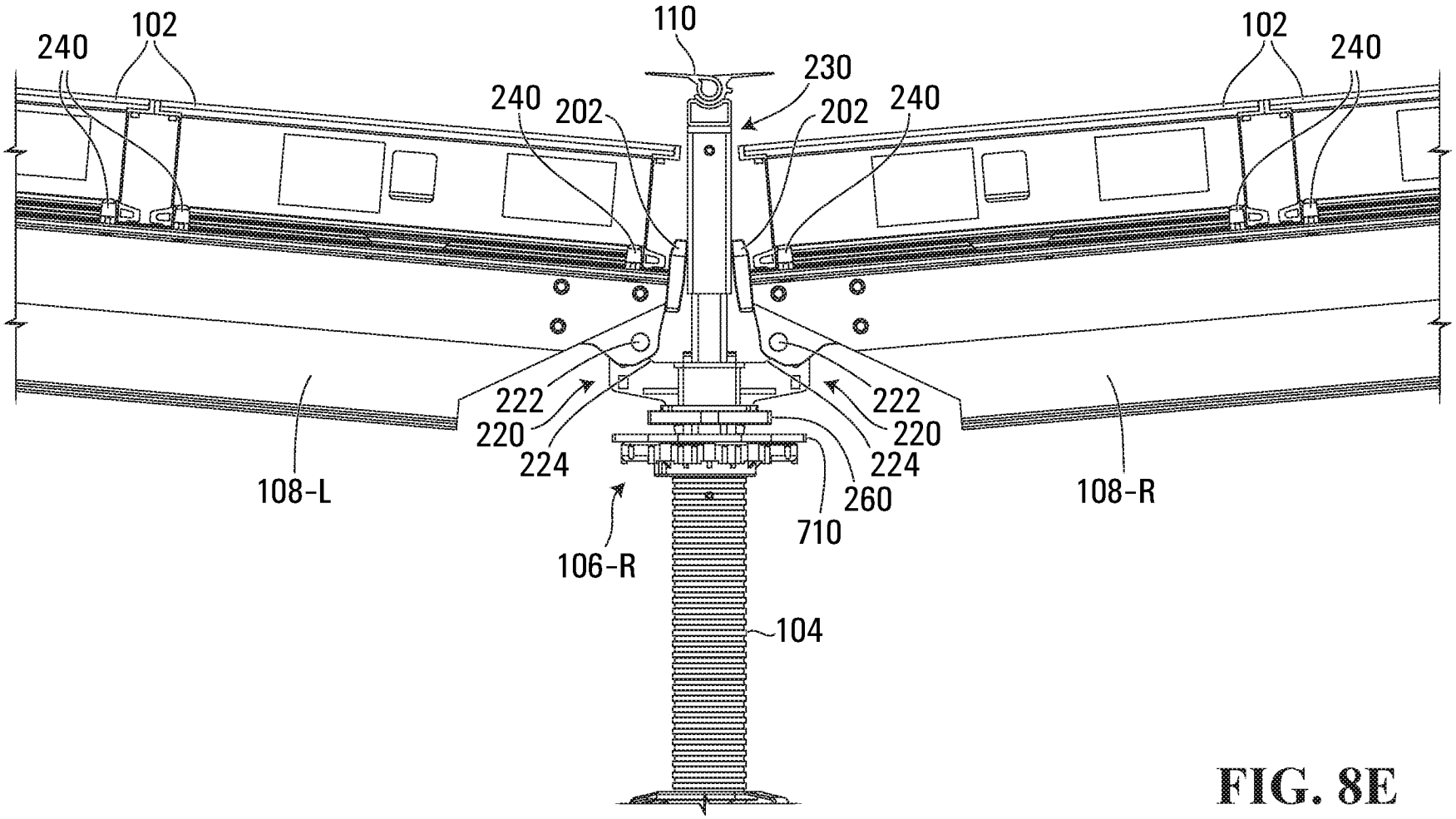
FIG. 8E is a close-up side view of the formwork system 100 in a second position in accordance with an example embodiment.

Release wedge 260 and side plates 265 provide a mechanism for releasing support arms 220 from a first position at a first height to a second position at a lower height. Release wedge 260 is supported by side plates 265 in the first position (FIGS. 3A-3E). Once the release wedge 260 is released, release wedge 260 drops closer to base plate 710, as shown in FIG. 8E. In one embodiment, the vertical distance between the first and second positions is approximately 100 mm.

Release wedge 260 defines a large central void 815. Central void 815 has a wide end and a narrow end. The narrow end has a width that is marginally larger than the width of central upstanding member 230 (for example, in one embodiment, central upstanding member 230 is 40 mm×40 mm; while the narrow end of void 815 has a width of 42 mm). The wide end of central void 815 has a width that is marginally larger than the width of central upstanding member 230 plus the thickness of the two side plates (for example, in one embodiment, each side plate is 10 mm thick for a total thickness of 60 mm; while the wide end of void 815 has a width of 62 mm).

Thus, side plates 265 (attached to central upstanding member 230) can only pass through the wide end of central void 815 of release wedge 260. To release support arms 220 from the first position at the first height (FIGS. 2A-2F) to the second position at the lower height (FIG. 8E), a user may strike release wedge 260 laterally, thereby moving it laterally so that side plates 265 can pass through wide end of central void 815. In one embodiment, release wedge 260 has tapered side portions 823 which allow for easier release of release wedge 260.

Figure 9D:
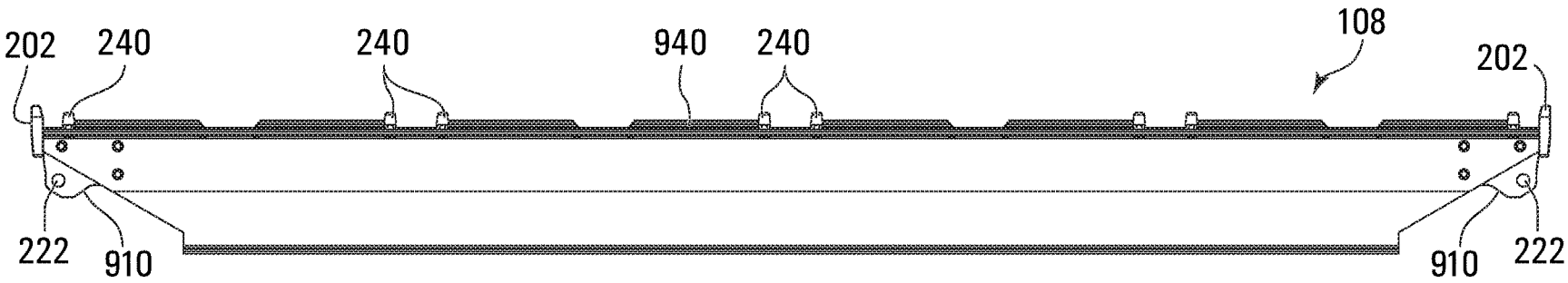
Figure 9E:
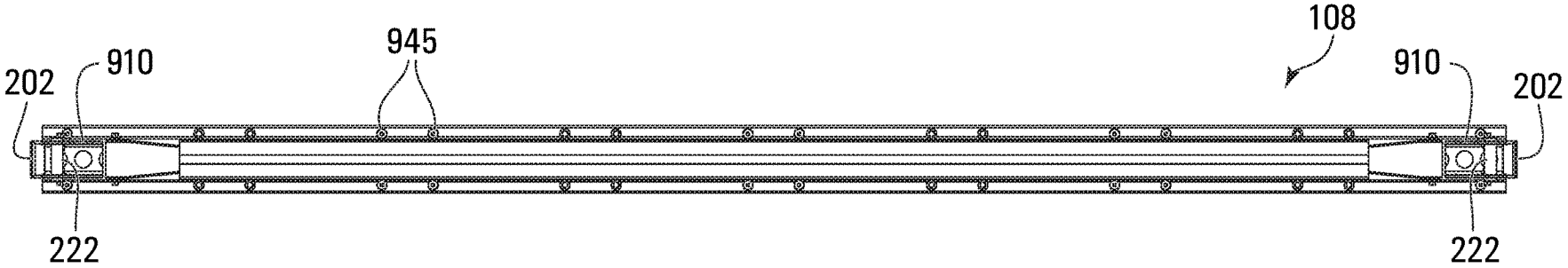
Figure 9H:
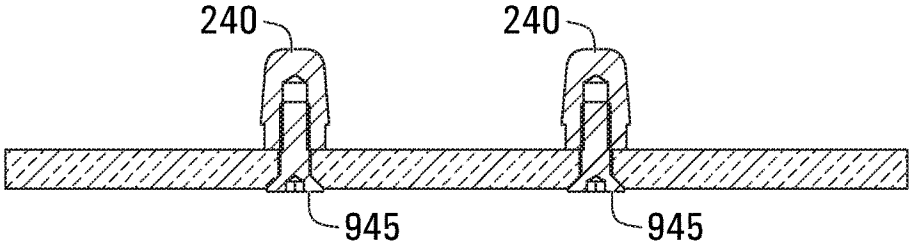
FIG. 9H is a cross-section view of protrusions of the beam of FIG. 9A.
Figure 9F:
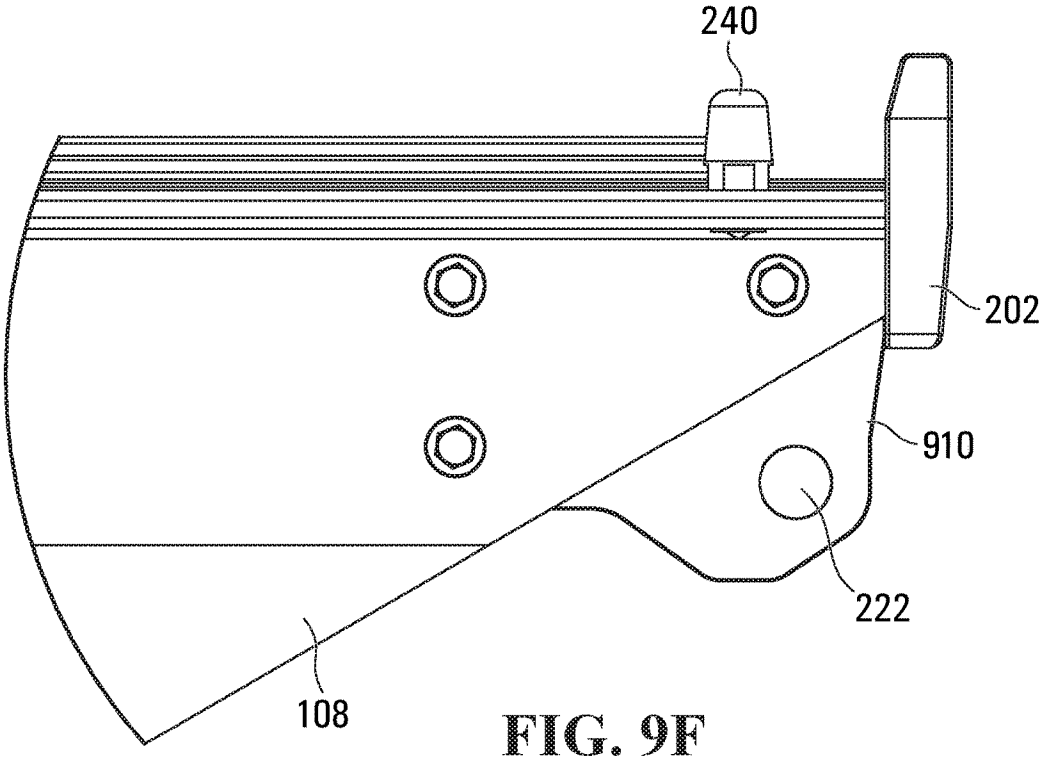
FIG. 9F is a close-up side view of an end of the beam of FIG. 9A.
Figure 9G:
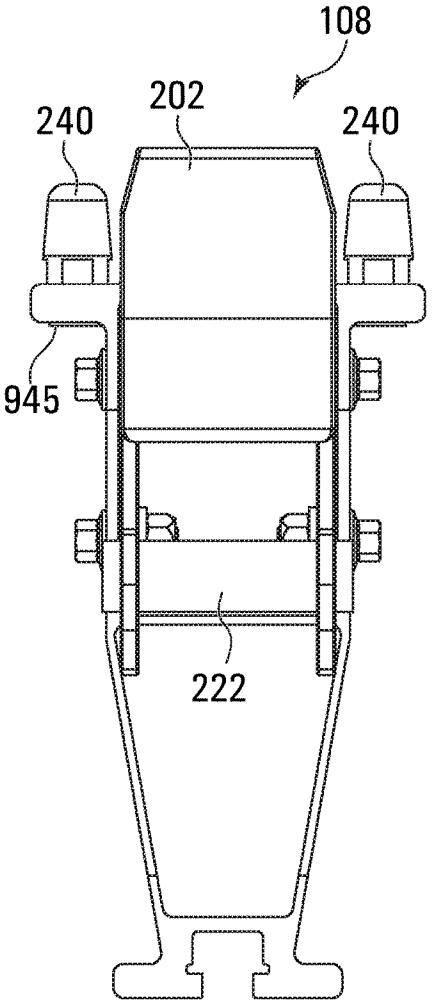
FIG. 9G is a side view of an end of the beam of FIG. 9A.
Figure 10A:
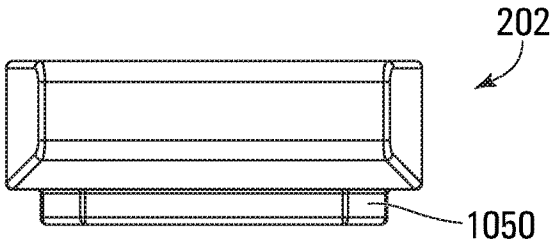
FIGS. 10A-10D are top, side, back, and top-perspective views of a foot of the beam of FIG. 9A in accordance with an example embodiment.
Figure 10C:
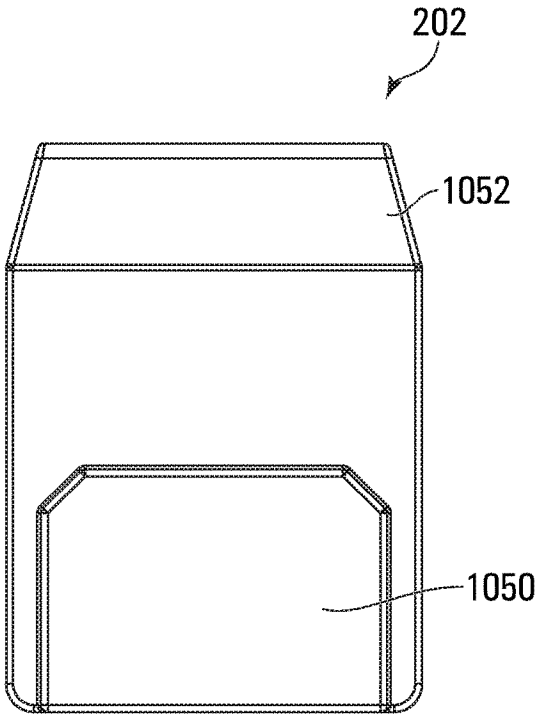
Figure 10B:
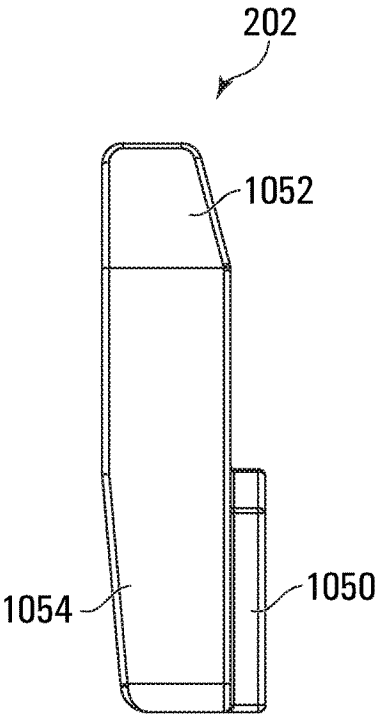
Figure 10D:
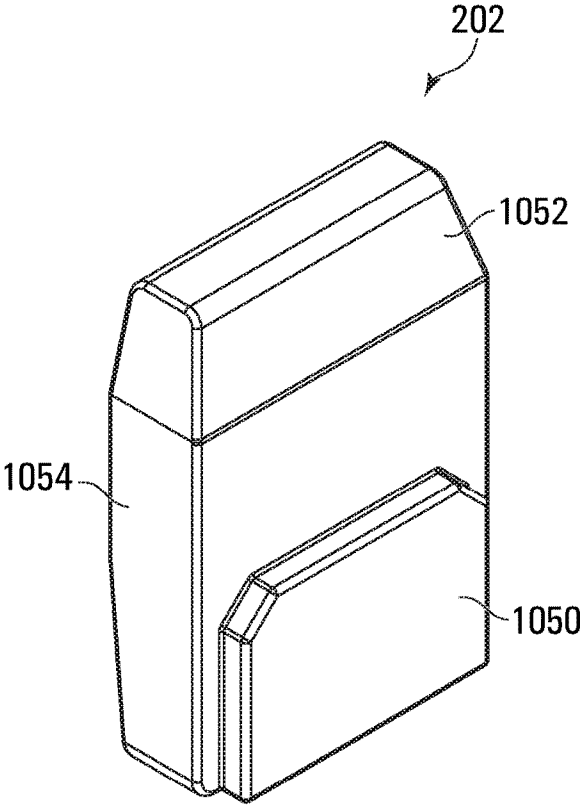

Reference is made to FIGS. 9A-9H, illustrating an example embodiment of beam 108 in isolation. In one embodiment, beam 108 is a generally hollow elongate member with tapered ends (FIGS. 9D and 9G). The tapered ends may help prevent beam 108 from hitting support 105 which the beam is mounted on.

In one embodiment, beam 108 is approximately 2.4 m long and 10 cm wide. Beams of different lengths may also be used (for example, in one embodiment, different beams 108 may have a length ranging from 4 feet to 8 feet). Beam 108 may be made of a lightweight material that can withstand the weight of concrete (for example, aluminum) to allow for easy manipulation of the beam.

In one example embodiment, beam 108 has a plurality of protrusions 240 extending upwardly from an upper surface thereof. Protrusions 240 may laterally secure forming panels 102 and prevent forming panels 102 from moving laterally. Protrusions 240 are positioned along the length of the upper surface of beam 108 in a pattern that corresponds to the type of forming panels 102 selected for use with beam 108. As shown in FIG. 9H, the upper surface of beam 108 may include a plurality of through-holes 945 for securing protrusions 240. For example, screws may be used to attach protrusions 240 via the through-holes.

Further, in one embodiment, beam 108 has a plurality of guides 940 extending upwardly from an upper surface thereof. Guides 940 are positioned along the length of the upper surface of beam 108 at the center to guide forming panels 102 into position.

In one example embodiment, beam 108 has attached to each end a saddle member 915 (shown in isolation in FIG. 9B), which protrudes outwardly. Saddle member 915 has two opposing side plates 910 which may be secured to an end or proximate an end of beam 108. For example, side plates 910 may be welded, riveted, or screwed to beam 108.

Side plates 910 support transverse bar 222 in position proximate to the end of beam 108. Transverse bar 222 may, for example, be welded to each of side plates 910 such that transverse bar 222 protrudes perpendicularly from beam 108. As previously discussed, transverse bar 222 supports beam 108 on a support arm 220 of support 108.

In one embodiment, transverse bar 222 is made of a metallic material, such as aluminum or steel. In one embodiment, transverse bar 222 is cylindrical in shape and is approximately 70 mm long and has a diameter of 20 mm. Notably, the diameter of transverse bar 222 may be selected in dependence on the material used (for example, a less stiff material, such as aluminum, may require transverse bar 222 to have added thickness to properly support beam 108).

Reference is made to FIGS. 10A-10D, illustrating an example embodiment of a foot 202 in isolation. Saddle member 915 also supports foot 202, which extends out from an end of saddle member 915. Foot 202 may also be welded to saddle member 915. Foot 202 may have an attachment member 1050 to provide an area which can be used to secure foot 202 to saddle member 915.

In one embodiment, foot 202 has tapered upper portion 1052 and rounded corners for added safety, as such a corner may be less sharp.

In one embodiment, foot 202 also has tapered lower portion 1054. Tapered lower portion 1054 may allow beam 108 to move more closely towards central upstanding member 230 when the beam is sloping down from a support head 106.

In one embodiment, foot 202 is made of a metallic material, such as aluminum or steel. In one embodiment, foot 202 is approximately 60 mm wide, 80 mm long and 20 mm thick. The thickness of foot 202 may require adjustment in dependence on the material used.

Figure 11A:
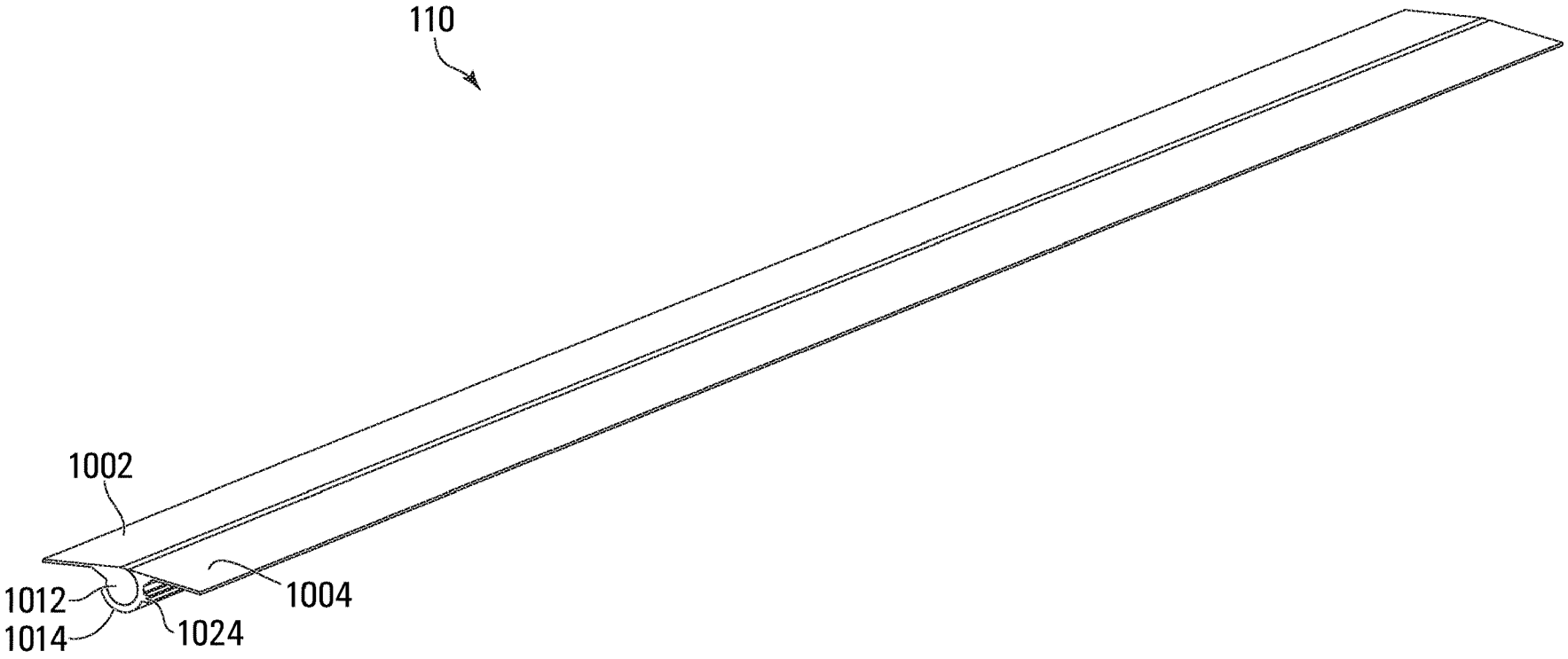
FIG. 11A is a top-perspective view of a compensation-strip for use with the formwork system 100 in accordance with an example embodiment.
Figure 11B:
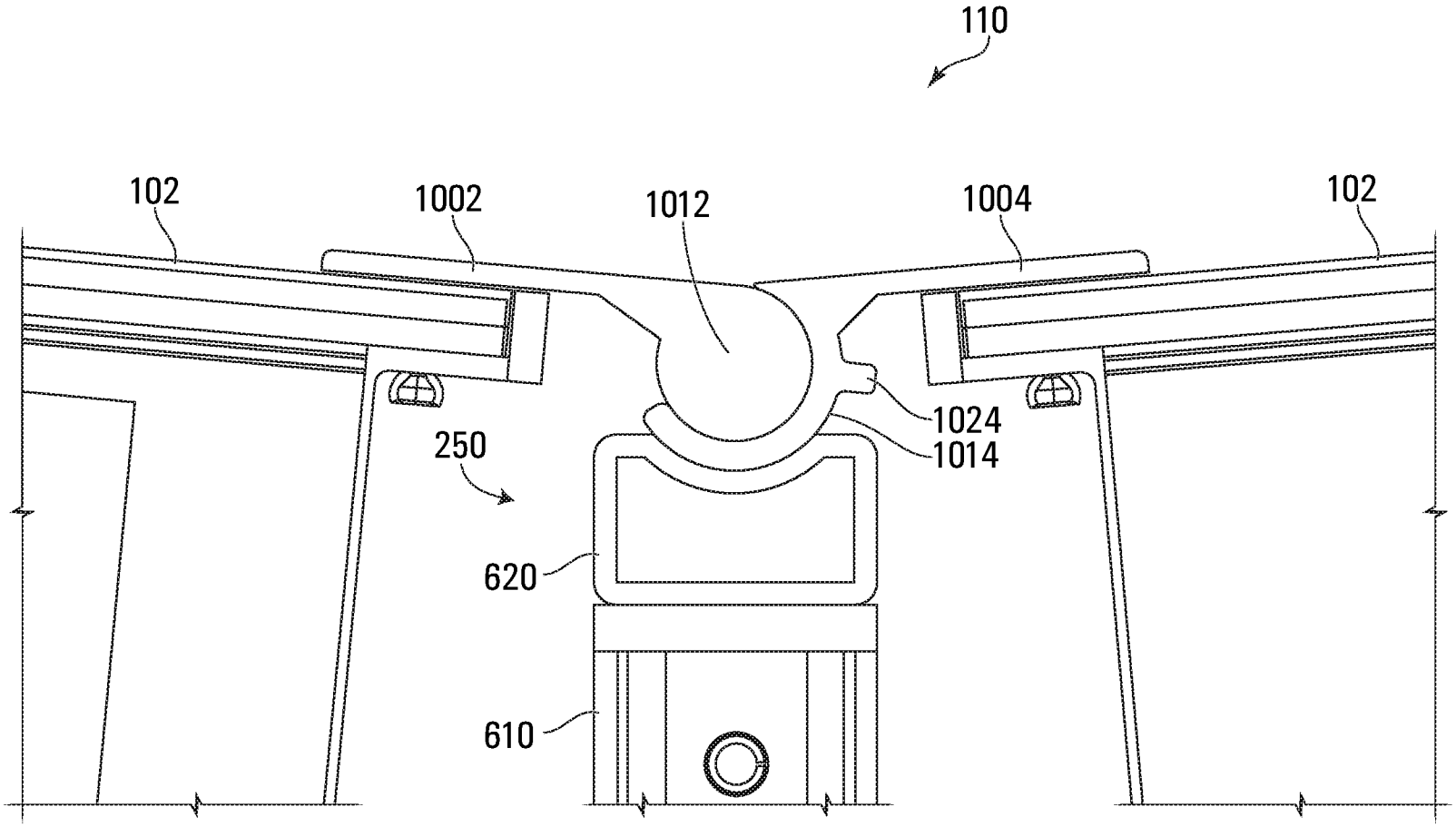
FIGS. 11B-11D are side views of the compensation-strip of FIG. 11A in use with the formwork system 100 in accordance with an example embodiments.
Figure 11C:
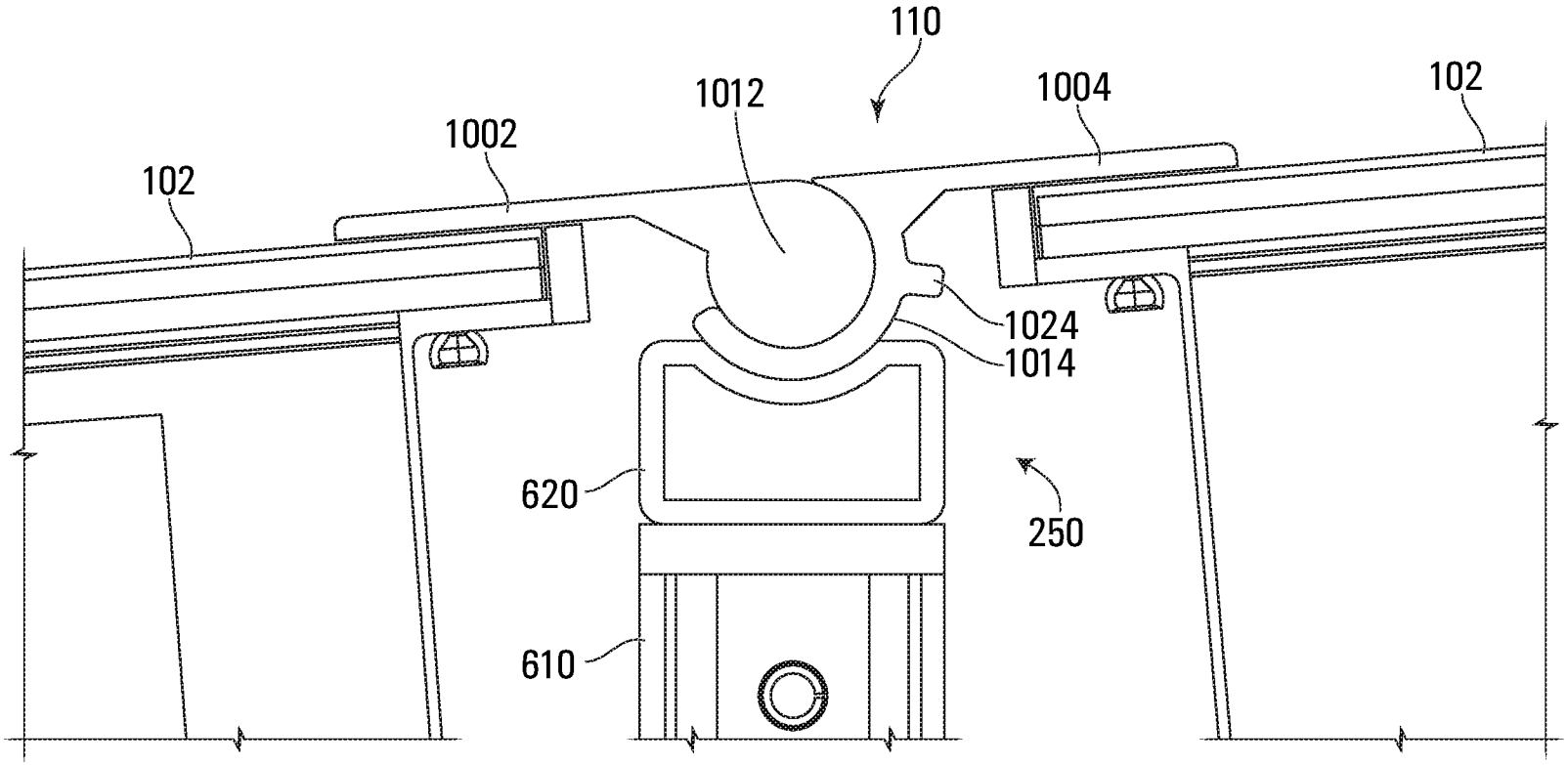
Figure 11D:
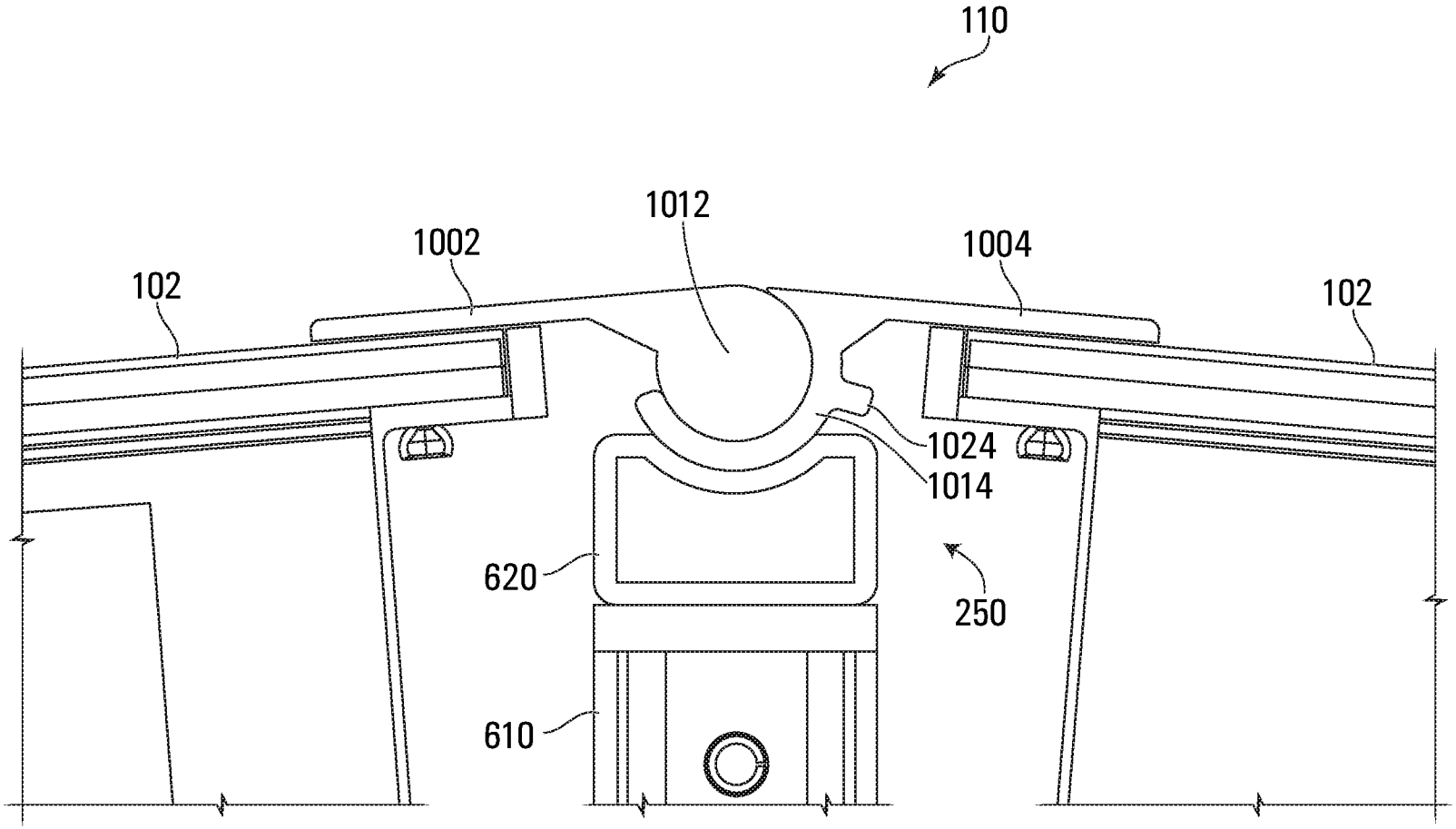

Reference is now made to FIG. 11A, illustrating an example embodiment of compensation-strip 110 in isolation, and FIGS. 11B-11D, illustrating an example embodiment of compensation-strip 110 as supported by upper support 250 of support head 106.

In one embodiment, compensation-strip 110 has two elongate panels 1002, 1004 hingedly coupled to one another. The length of each panel 1002, 1004 is selected to match the width of an associated forming panel 102.

In one embodiment, compensation-strip 110 has a central hinge portion. For example, panel 1002 may have at one side thereof a substantially cylindrical joint 1012 and panel 1004 may have at one end thereof a corresponding semi-circular joint 1014. Cylindrical joint 1012 may be slotted into the corresponding semi-circular joint 1014 to hingedly couple panels 1002 and 1004 to one another.

In use, an edge of each of panels 1002, 1004 rest on adjacent forming panels 102 and the central hinge portion rests on cross-member 620 of upper support 250 (FIGS. 11B-11D).

In one embodiment, panel 1004 has a notch 1024. In some embodiments, compensation-strip 110 may attach to freshly set concrete. Notch 1024 may be used to remove compensation-strip 110.

As illustrated in FIGS. 11B-11D, panel 1002 may be rotated about joint 1014 to form various angles to correspond with the incline of adjacent beams 108. For example, compensation-strip 110 in FIG. 11B is oriented to create a 'valley', compensation-strip 110 in FIG. 11C is oriented to create a 'ramp', and compensation-strip 110 in FIG. 11D is oriented to create a 'peak'.

Hingedly coupled panels 1002 and 1004 allow compensation-strip 110 to fill gaps of different widths. In one embodiment, the width of the gap is approximately 60 mm in the 'valley' orientation, approximately 90 mm in the 'ramp' orientation, and approximately 115 mm in the 'ramp' orientation. Thus, compensation-strip 110 in the example given can accommodate gap widths in the range of 60 mm to 115 mm.

Of course, the above described embodiments are intended to be illustrative only and in no way limiting. The described embodiments are susceptible to many modifications of form, arrangement of parts, details and order of operation. The invention is intended to encompass all such modification within its scope, as defined by the claims.

What is claimed is:

1. A formwork system for supporting one or more forming panels to form a horizontal concrete surface, said system comprising:

a height-adjustable support comprising a central upstanding member providing a vertical abutment surface and a support arm having an inclined portion extending up and away from said central upstanding member;

a beam comprising a transverse bar proximate an end, said transverse bar supported by said inclined portion of said support arm so that said transverse bar moves laterally relative to said inclined portion as said support arm is moved vertically; and a foot extending from said end of said beam and abutting said vertical abutment surface, wherein said vertical abutment surface opposes lateral movement of said beam relative to said upstanding member;

wherein an increase in the height of said support causes said transverse bar to move towards said central upstanding member along said inclined portion.

2. The formwork system of claim 1, wherein a decrease in the height of said support causes said transverse bar to move away from said central upstanding member along said inclined portion.

3. The formwork system of claim 1, wherein an incline angle of said beam is adjustableby adjusting the height of said support.

4. The formwork system of claim 1, wherein said foot partially abuts said central upstanding member.

5. The formwork system of claim 4, wherein a lower portion of said foot abuts said central upstanding member to set said beam at an incline sloping downwardly from said support.

6. The formwork system of claim 5, wherein said lower portion of said foot is tapered.

7. The formwork system of claim 4, wherein an upper portion of said foot abuts said vertical member to set said beam at an incline sloping upwardly from said support.

8. The formwork system of claim 1, wherein said support arm has a flat portion extending away from said central upstanding member and wherein said inclined portion extends up and away from said flat portion.

9. The formwork system of claim 1, wherein said support arm has a vertical portion extending upwardly from said inclined portion.

10. The formwork system of claim 1, wherein said inclined portion is a straight incline.

11. The formwork system of claim 10, wherein said inclined portion is inclined at an angle ranging from 30 to 40 degrees.

12. The formwork system of claim 11, wherein said inclined portion is inclined at a 35 degree angle.

13. The formwork system of claim 1, wherein said support has two of said support arms positioned on opposite sides of said support.

14. The formwork system of claim 1, wherein said height-adjustable support is mounted on a vertical prop.

15. The formwork system of claim 14, wherein said vertical prop is height-adjustable.

16. The formwork system of claim 1, wherein said support arm is vertically movable relative to said central upstanding member.

17. The formwork system of claim 1, further comprising a first pair of vertical props suspending said beam and a second pair of vertical props suspending a second beam in a substantially parallel position to said beam, and wherein the one or more forming panels is supported on each of said beam and said second beam to form a suspended horizontal surface suitable for pouring concrete thereon.

18. The formwork system of claim 17, wherein said beam has protrusions protruding from an upper surface thereof and wherein said protrusions engage said forming panels to prevent lateral movement of said forming panels.

19. The formwork system of claim 1, further comprising a compensation-strip for filling a gap between two adjacent forming panels, said compensation-strip comprising first and second panels hingedly attached to one another, and wherein an edge of each of said first and second panels rests on one of the two adjacent forming panels.

* * * * *